US006474883B1

(12) United States Patent
Kawakami et al.

(10) Patent No.: US 6,474,883 B1
(45) Date of Patent: Nov. 5, 2002

(54) PRINTER HAVING ROLL PAPER HOUSING

(75) Inventors: Hideki Kawakami, Hata-machi (JP); Satoshi Iwaya, Suwa (JP); Kazuya Oshida, Hara-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/664,951

(22) Filed: Sep. 19, 2000

(30) Foreign Application Priority Data

| | | |
|---|---|---|
| Sep. 22, 1999 | (JP) | 11-269394 |
| Jan. 31, 2000 | (JP) | 2000-022908 |
| Feb. 1, 2000 | (JP) | 2000-024424 |
| Apr. 6, 2000 | (JP) | 2000-104971 |
| Apr. 12, 2000 | (JP) | 2000-111216 |
| Jun. 6, 2000 | (JP) | 2000-169241 |
| Jun. 6, 2000 | (JP) | 2000-169242 |

(51) Int. Cl.[7] ..... B41J 3/02
(52) U.S. Cl. ..... 400/613; 400/611; 400/691; 400/693
(58) Field of Search ..... 400/613, 692, 400/611, 613.1, 693, 691, 612

(56) References Cited

U.S. PATENT DOCUMENTS

| | | | | |
|---|---|---|---|---|
| 4,632,585 A | * | 12/1986 | Oyamatsu et al. | 400/613 |
| 4,641,980 A | * | 2/1987 | Matsumoto et al. | 400/120 |
| 4,663,638 A | | 5/1987 | Hirose | |
| 4,860,031 A | | 8/1989 | Lejcek | |
| 5,230,576 A | * | 7/1993 | Sone | 400/649 |
| 5,528,273 A | | 6/1996 | Takizawa et al. | |
| 5,528,278 A | | 6/1996 | Takizawa et al. | |
| 5,887,999 A | | 3/1999 | Smith et al. | |
| 6,022,158 A | | 2/2000 | Nakayama et al. | |

FOREIGN PATENT DOCUMENTS

| | | |
|---|---|---|
| JP | 61-84270 | 4/1986 |
| JP | 62-158067 | 7/1987 |
| JP | 63-098451 | 4/1988 |
| JP | 01-097670 | 4/1989 |
| JP | 01-249371 | 10/1989 |
| JP | 03-258575 | 11/1991 |
| JP | 5-147291 | 6/1993 |
| JP | 08-002754 | 1/1996 |
| JP | 10-278366 | 10/1998 |

* cited by examiner

*Primary Examiner*—Andrew H. Hirshfeld
*Assistant Examiner*—Kevin D. Williams
(74) *Attorney, Agent, or Firm*—Hogan & Hartson, LLP

(57) ABSTRACT

A printer has a roll paper housing for housing the recording paper roll, and an opening on its front side covered with a cover. The cover can be opened and closed by operating an operating lever attached to a movable-side paper feed mechanism section supported by a parallel linking mechanism. By pulling the operating lever toward this side of the printer, the movable-side paper feed mechanism section moves forward from a position above the roll paper housing while keeping the posture thereof. It is therefore possible to a sufficient space for charging the recording paper roll. The recording paper roll is charged, and the recoding sheet is drawn therefrom and passed above the movable-side paper feed mechanism section. In this state, by closing the cover by operating the operating lever, the movable-side paper feed mechanism section moves closer to a fixed-side paper feed mechanism section, thus automatically achieving the printable state in which the recording sheet is held between them.

39 Claims, 18 Drawing Sheets

PRINTER HAVING ROLL PAPER HOUSING

BACKGROUND OF THE INVENTION

1. Field of the Invention

The present invention relates to a printer performing print by means of a printing head such as an ink-jet head onto a recording sheet of paper delivered from a recording paper roll housed in a roll paper housing. More particularly, the invention relates to a printer of a type in which replacement operation of a recording sheet roll is accomplished via an opening formed in the front surface of a roll paper housing.

2. Description of the Related Art

As a printer printing on a recording paper roll, there is known a type in which an opening/closing cover for replacing a recording paper roll is attached to the front surface of the printer, and when the cover is pulled down forward, the roll paper housing is exposed. Such a printer is disclosed, for example, in JP-A 3-258575. In the disclosed printer, a printing head is arranged downward above the roll paper housing, and a platen roller for regulating the printing position on the recording sheet is arranged opposite thereto. The recording sheet delivered from a recording paper roll housed in the roll paper housing is printed while passing on the printing position, and then, discharged outside from a paper discharge port formed above an opening for replacing the recording sheet in the front portion of the printer. In general, a cutter is attached near the paper discharge port to permit cutting of a tape-shaped recording sheet after printing automatically or manually.

The cover blocking the opening of the roll paper housing is locked by a locking mechanism at a closing position, so that, by releasing the lock, the cover falls down forwardly by a spring force to expose the roll paper housing. A platen roller which is a component part of the paper feed mechanism is attached on the cover side, to facilitate replacement of the recording sheet via the opening.

In a cover opening/closing mechanism in which parts composing the paper feed mechanism such as the platen roller are as well moved, together with the cover, the paper feed troubles may be caused unless the movable-side components of the paper feed mechanism returns to the original positions accurately in a closed state of the cover. Particularly when an ink-jet head is used as a printing head, the platen gap fluctuates, producing disadvantages such as a decrease in the print quality.

On the other hand, the printer using a recording paper roll is popularly applied as a receipt issuing printer at pay window of a kiosk or the like, and in such a case, the available space for installation is small in many cases. There is and has been therefore an increasing demand for development of a smaller-sized or more compact printer in this area of application. With this fact in view, it is desirable to configure a locking mechanism for locking the cover blocking the roll paper housing at the closed position thereof, and a mechanism for releasing the lock by the locking mechanism, into a compact shape without the need for a large space for installation.

In addition, it is always demanded to permit simple and safe opening/closing operation of the cover, and easy replacement of the recording paper roll.

SUMMARY OF THE INVENTION

An object of the present invention is therefore to provide a printer which carries out replacement of the recording paper roll by opening the cover attached to the front surface of the printer, which permits simple replacement operation of the recording paper roll.

Another object of the invention is to provide a printer which carries out replacement of the recording paper roll by opening the cover attached to the front surface of the printer, and causes movement of also some component parts of the paper feed mechanism transferring a recording sheet by a printing head via the printing position together with the cover, which permits accurate return of the moving parts, together with the cover, to the operating positions.

Still another object of the invention is to provide a printer which carries out replacement of the recording paper roll by opening the cover attached to the front surface of the printer, and causes movement of also some component parts of the paper feed mechanism transferring a recording sheet by a printing head via the printing position together with the cover, which permits accurate return of the moving parts, together with the cover, to the operating position, and ensures certain feed of recording sheets of paper without causing slip.

Further another object of the invention is to provide a printer which carries out replacement of the recording paper roll by opening the cover attached to the front surface of the printer, and in which a locking mechanism locking the cover at the closed position and a mechanism for releasing lock made by the locking mechanism are small and compact in size.

In addition, another object of the invention is to provide a printer which carries out replacement of the recording paper roll by opening the cover attached to the front surface of the printer, which permits simple and safe opening/closing operation of the cover.

To achieve the above and other objects, the printer of the present invention comprises a roll paper housing; a cover attached to the front surface of the printer for opening and closing the roll paper housing; a printing head for printing on a tape-shaped recording sheet of paper delivered from a recording paper roll charged in the roll paper housing; a paper feed mechanism for transferring the tape-shaped recording sheet through a printing position of the printing head; the paper feed mechanism comprising a fixed-side paper feed mechanism section and a movable-side paper feed mechanism section movable to an operating position and a shunting position distant from the fixed-side paper feed mechanism section, engaging with the fixed-side paper feed mechanism section; and the recording sheet being held between the fixed-side paper feed mechanism section and the movable-side paper feed mechanism section; and a parallel linking mechanism which causes the movable-side paper feed mechanism section to move to the operating position in linkage with the closing operation of the cover, and causes the movable-side paper feed mechanism section to move from the operating position to the shunting position while keeping the posture at the operating position, in linkage with the opening operation of the cover.

The aforementioned parallel linking mechanism may have a configuration in which the parallel linking mechanism has a pair of swinging arms; and the lower end of each swinging arm is rotatably supported by the roll paper housing side, and the upper end of each swinging arm is hinge-connected by the movable-side paper feed mechanism section.

The aforementioned paper feed mechanism may have a configuration in which the fixed-side paper feed mechanism section comprises a first roller and a second roller arranged in the upstream and in the downstream, respectively, of the printing head in the recording paper transferring direction; the movable-side paper feed mechanism section comprises a third roll in contact with the first roller and a fourth roller in contact with the second roller at the operating position; and the recording sheet is transferred between the first and third rollers, and between the second and fourth rollers.

In this case, the fixed-side paper feed mechanism section may have a configuration in which it further comprises a motor driving one of the first and second rollers, and a driven gear for transferring the driving force of the motor to the movable-side paper feed mechanism section. The movable-side paper feed mechanism section may further comprise a follower gear engaging with the driven gear at the operating position, and it suffices to derive one of the third and fourth rollers by driving force of the motor transferred to the follower gear.

Typically, the configuration may be such that the first and fourth rollers are driven by the motor. In this case, the movable-side paper feed mechanism section should preferably have a spring which presses the third roller against the first roller at the operating position.

It is desirable to adopt a configuration in which the second roller has a shape capable of being pressed with a slight contact portion against a recording sheet transferred between the second roller and the fourth roller, so as to rotate along with rotation of the fourth roller.

When the printing head is an ink-jet head or the like, the movable-side paper feed mechanism section should preferably comprise a roller supporting member rotatably supporting the third and fourth rollers, and a platen plate attached to the roller supporting member and arranged between the third and fourth rollers; and ends on one side of the pair of swinging arms should preferably be hinge-connected to the roller supporting member.

The printer of the invention comprises a roll paper housing; a cover attached to the front surface of the printer for opening and closing the roll paper housing; a printing head for printing on a tape-shaped recording sheet of paper delivered from a recording paper roll charged in the roll paper housing; a paper feed mechanism for transferring the tape-shaped recording sheet through a printing position of the printing head; the paper feed mechanism comprising a fixed-side paper feed mechanism section and a movable-side paper feed mechanism section movable to an operating position and a shunting position distant from the fixed-side paper feed mechanism section, engaging with the fixed-side paper feed mechanism section; and the recording sheet being held between the fixed-side paper feed mechanism section and the movable-side paper feed mechanism section; and a parallel linking mechanism which causes the movable-side paper feed mechanism section to move to the operating position in linkage with the closing operation of the cover, and causes the movable-side paper feed mechanism section to move from the operating position to the shunting position while keeping the posture at the operating position, in linkage with the opening operation of the cover; and further comprises an operating lever vertically rotatably attached to the movable-side paper feed mechanism section, and a locking mechanism for locking the movable-side paper feed mechanism section at the operating position; wherein, when the operating lever is turned, locking of the movable-side paper feed mechanism section by the locking mechanism is released.

In order to smoothly accomplish discharge of the printed recording sheets discharged by the paper feed mechanism, the operating lever should preferably have a guide table projecting from the movable-side paper feed mechanism section in front of the printer body; and, when the movable-side paper feed mechanism section is at the operating position, the recording sheet discharged between the movable-side paper feed mechanism section and the fixed-side paper feed mechanism section to outside is guided by the guide table.

The locking mechanism may comprise a vertically rotatable hook integrally with the operating lever, a hook receiver with which the hook is engaged from below, formed on the printer body side, and a spring imparting a force to the hook in a direction of engaging with the hook receiver.

Furthermore, the printer of the invention should preferably further comprise operating lever rotating means for vertically rotating the operating lever relative to the movable-side paper feed mechanism section in linkage with opening and closing of the cover.

In this case, the operating lever rotating means may comprise an engagement section formed on the operating lever at a position in front of the printer body from the rotation center of the operating lever, and an engaged section formed on the parallel linking mechanism; and the engagement section engages with the engaged section in linkage with the opening operation of the cover, and pushes up the operating lever around the rotation center so that the front side portion thereof moves upward. According to this configuration, the front portion of the operating lever attached to the cover is directed upward with the cover open, i.e., with the tilted cover. The operating lever can therefore be easily grasped, thus facilitating the closing operation of the open cover.

The aforementioned operating lever rotating means may comprise an engagement section formed on the operating lever at a position in front of the printer body from the rotation center of the operating lever, and an engaged section formed on the parallel linking mechanism; and the engagement section engages with the engaged section in linkage with the closing operation of the cover, and causes the operating lever around the rotation center so that the rear side portion moves downward, and when the operating position is reached by the movable-side paper feed mechanism section, engagement between the engagement section and the engaged section is released.

According to this configuration, it is possible to achieve a locked state of the cover by the locking mechanism by making use of the rotating motion of the operating lever, thus permitting easy locking operation of the cover at the closing position.

In a preferred embodiment, the portion of the paper feed mechanism on the recording sheet discharge side after printing is provided with a cutter for cutting the recording sheets. The cutter may comprise a movable edge and a fixed edge. The movable edge may be provided in the fixed-side paper feed mechanism section, and the fixed edge may be provided in the movable-side paper feed mechanism section. In this case, the operating lever should preferably have a protecting cover covering the front portion of the fixed edge so that the fixed edge exposed when the movable-side paper feed mechanism is at the shunting position never injure operator's fingers or the like.

In another preferred embodiment, the printer should preferably further comprise a movable guide for guiding a recording sheet delivered from the recording sheet roll housed in the roll paper housing into the paper feed mechanism section; wherein the movable guide should preferably be attached to the movable-side paper feed mechanism section, and move in linkage with the operating lever.

More preferably, the movable guide rotates around the rotation center of the operating lever integrally therewith.

According to this configuration, when the movable-side paper feed mechanism is at the operating position, it is possible to move the movable guide without causing slip of the recording sheet so that the recording sheet is introduced into the paper feed mechanism from the transferring direction by the paper feed mechanism without fail. When the movable-side paper feed mechanism section moves to the shunting position, the movable guide can be moved so that the movable guide never hits the component parts of the fixed-side paper feed mechanism section.

In a preferred embodiment, the fixed-side paper feed mechanism section may have a first roller and a second roller arranged in the upstream and in the downstream, respectively, of the printing head in the recording sheet transferring direction; the movable-side paper feed mechanism section has a third roller in contact with the first roller and a fourth roller in contact with the second roller at the operating position; the recording sheet is transferred between the first and third rollers and between the second and fourth rollers.

When such a paper feed mechanism is used, there should preferably be provided a spring which presses the movable guide so as to be positioned on the first roller side relative to the contact positions of the first and third rollers, when the movable-side paper feed mechanism section is at the operating position. In this configuration, the winding angle onto the first roller of the recording sheet guided between the first and third rollers by the movable guide becomes larger. By using a driven roller as the first roller, therefore, it is possible to transfer the recording sheet accurately toward the printing position without the risk of occurrence of slip.

In order to detect whether or not the cover is closed, it suffices to arrange a guide detector for detecting the position of the movable guide. In order to detect whether or not the recording sheet delivered from the roll paper housing has been drawn out via the movable guide, it suffices to arrange a recording sheet detector for detecting whether or not there is a recording sheet on the movable guide when the movable-side paper feed mechanism section is at the operating position.

The printer of the invention comprises a roll paper housing; a cover attached to the front surface of the printer for opening and closing the roll paper housing; a printing head for printing on a tape-shaped recording sheet of paper delivered from a recording paper roll charged in the roll paper housing; a paper feed mechanism for transferring the tape-shaped recording sheet through a printing position of the printing head; the paper feed mechanism comprising a fixed-side paper feed mechanism section and a movable-side paper feed mechanism section movable to an operating position and a shunting position distant from the fixed-side paper feed mechanism section, engaging with the fixed-side paper feed mechanism section; and the recording sheet being held between the fixed-side paper feed mechanism section and the movable-side paper feed mechanism section; and a parallel linking mechanism which causes the movable-side paper feed mechanism section to move to the operating position in linkage with the closing operation of the cover, and causes the movable-side paper feed mechanism section to move from the operating position to the shunting position while keeping the posture at the operating position, in linkage with the opening operation of the cover. The roll paper housing has a roll holder supporting the recording sheet roll; at least a part of the roll holder is a holder moving section forwardly rotatable around the lower end thereof; and the holder moving section rotates forwardly in linkage with the opening operation of the cover.

The roll holder may comprise a bottom wall portion, a front wall portion opposite to the cover, a rear wall portion, and right and left side portions. In this case, the holder movable section suffices to contain at least the front wall portion.

The printer of the invention comprises a roll paper housing; a cover attached to the front surface of the printer for opening and closing the roll paper housing; a printing head for printing on a tape-shaped recording sheet of paper delivered from a recording paper roll charged in the roll paper housing; a paper feed mechanism for transferring the tape-shaped recording sheet through a printing position of the printing head; the paper feed mechanism comprising a fixed-side paper feed mechanism section and a movable-side paper feed mechanism section movable to an operating position and a shunting position distant from the fixed-side paper feed mechanism section, engaging with the fixed-side paper feed mechanism section; and the recording sheet being held between the fixed-side paper feed mechanism section and the movable-side paper feed mechanism section; and a parallel linking mechanism which causes the movable-side paper feed mechanism section to move to the operating position in linkage with the closing operation of the cover, and causes the movable-side paper feed mechanism section to move from the operating position to the shunting position while keeping the posture at the operating position, in linkage with the opening operation of the cover; wherein the lower end of the cover is rotatably supported on the roll paper housing side; and has a spring always pressing the cover against the parallel linking mechanism.

DESCRIPTION OF THE PREFERRED EMBODIMENTS

An embodiment of the roll paper printer of the ink-jet type to which the present invention is applied will now be described with reference to the drawings.

Printer Exterior Configuration

Figure 1:
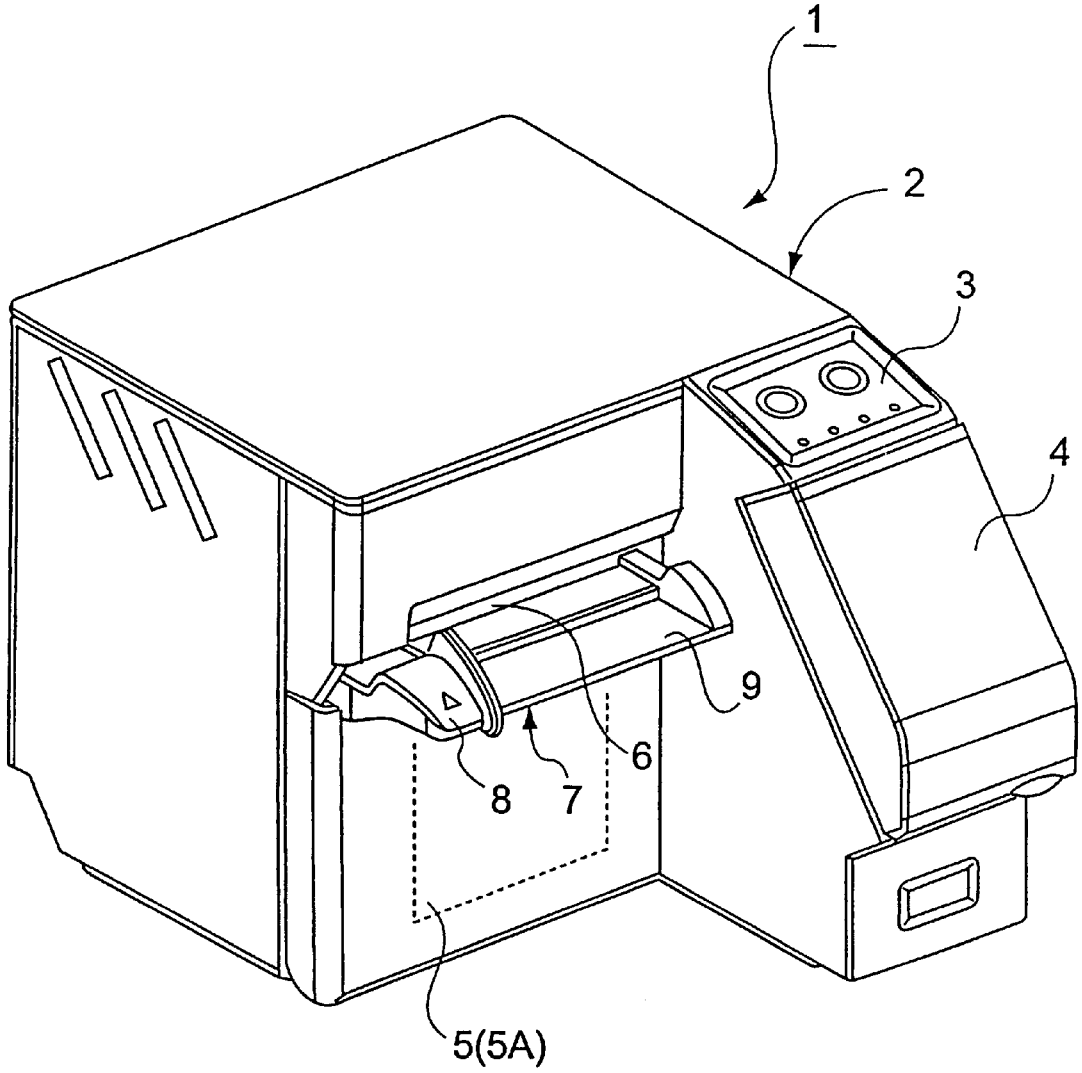
FIG. 1 is a front side perspective view showing the exterior shape of the roll paper printer of an embodiment of the present invention.
Figure 2:
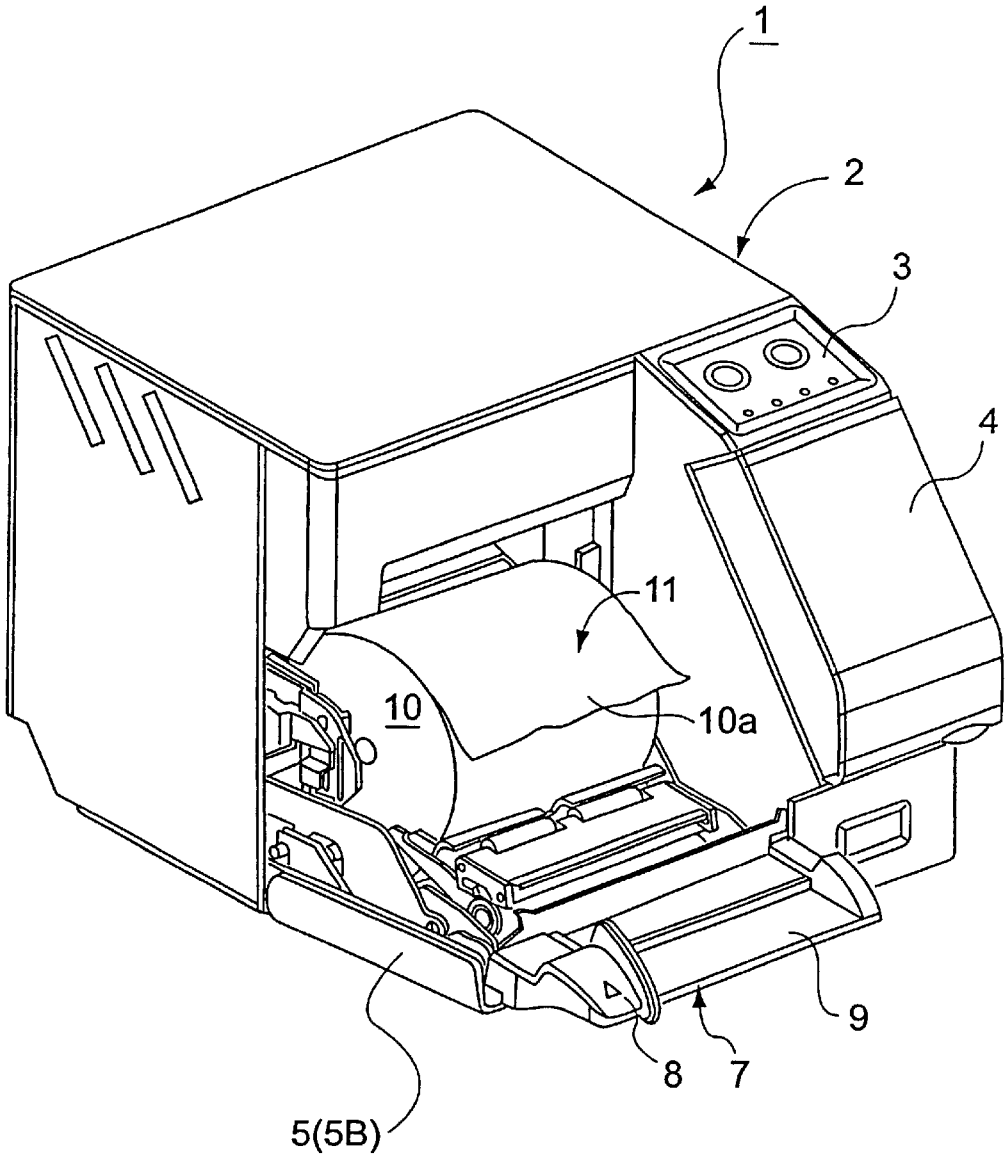
FIG. 2 is a front side perspective view showing an opened roll paper housing of the roll paper printer shown in FIG. 1.

FIG. 1 is a front side perspective view showing the exterior shape of the roll paper printer of this embodiment; and FIG. 2 is a front side perspective view showing the state in which a roll paper housing thereof is opened. As shown in FIGS. 1 and 2, the roll paper printer 1 of this embodiment has an exterior case 2. The exterior case 2 has a rectangular shape as a whole, and the right-side portion thereof on the printer front surface projects forward in a trapezoidal shape. An operating section 3 is formed on the upper surface of this projection, and the portion inclining forward following this upper surface portion forms an opening/closing cover 4 for mounting or replacing the ink cartridge.

An opening/closing cover 5 for mounting or replacing a recording paper roll is attached to the printer front surface of the exterior case 2. A discharge port 6 for discharging the recording sheet after printing is formed immediately above this cover 5. An operating lever 7 for opening/closing operation of the cover 5 substantially horizontally projects forward from this discharge port 6. The operating lever 7 has a left end portion serving as an operating knob 8, and a right end portion serving as a discharge table 9 for guiding horizontally the recording sheet after printing discharged from the discharge port 6.

The cover 5 of this embodiment is rotatable between an upright closed position 5A as shown in FIG. 1 and a full-opened position 5B where the cover falls down substantially horizontally as shown in FIG. 2. When the cover 5 is fully opened as shown in FIG. 2, a roll paper housing 11 for housing a recording paper roll 10 formed in the interior of the printer exterior case 2 is exposed. In this state, the recording paper roll is mounted or replaced.

Internal Configuration

Figure 3:
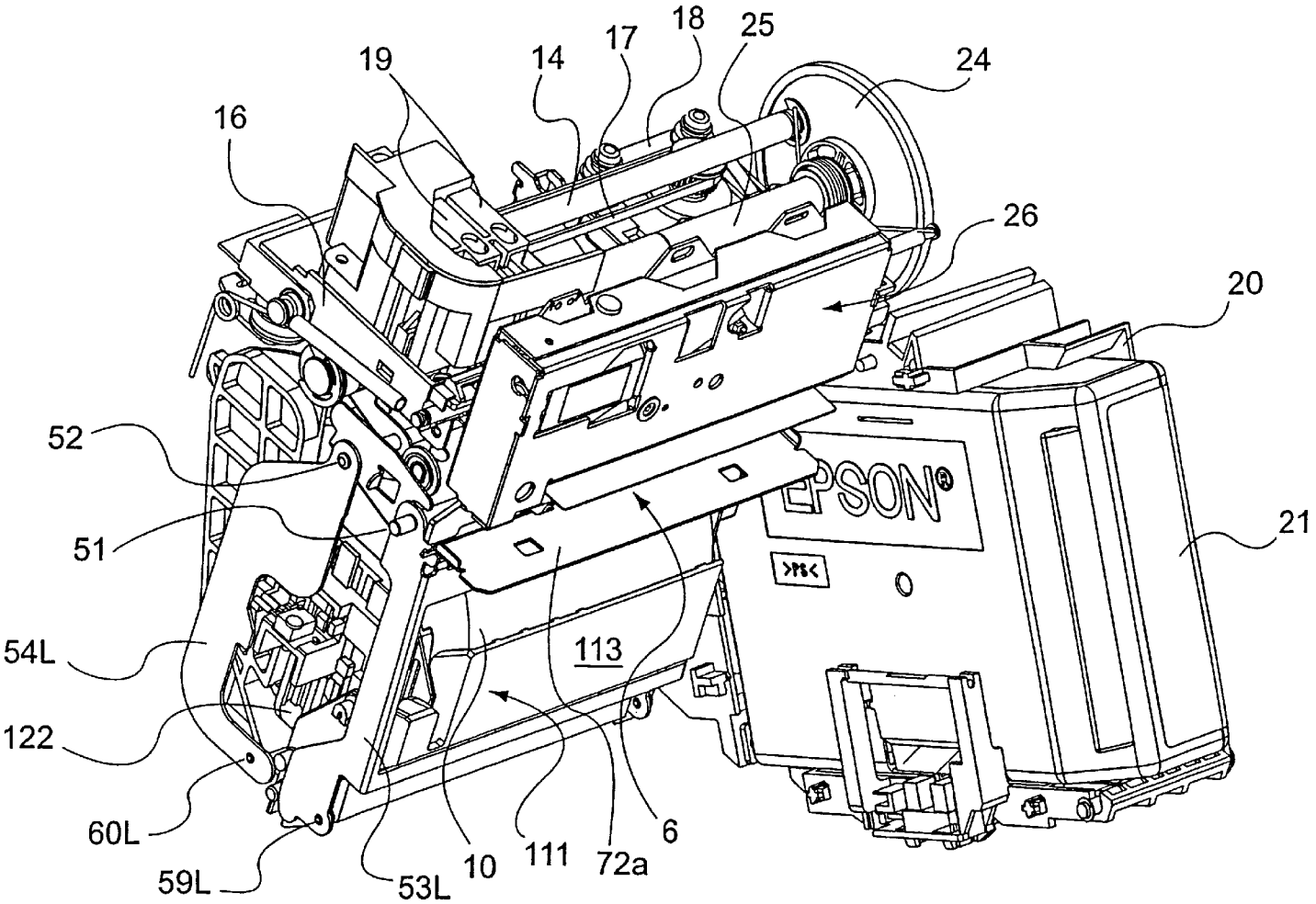
FIG. 3 is a front side view showing the internal structure of the roll paper printer shown in FIG. 1: the exterior case, the operating knob of the operating lever and the discharge table are excluded.
Figure 4:
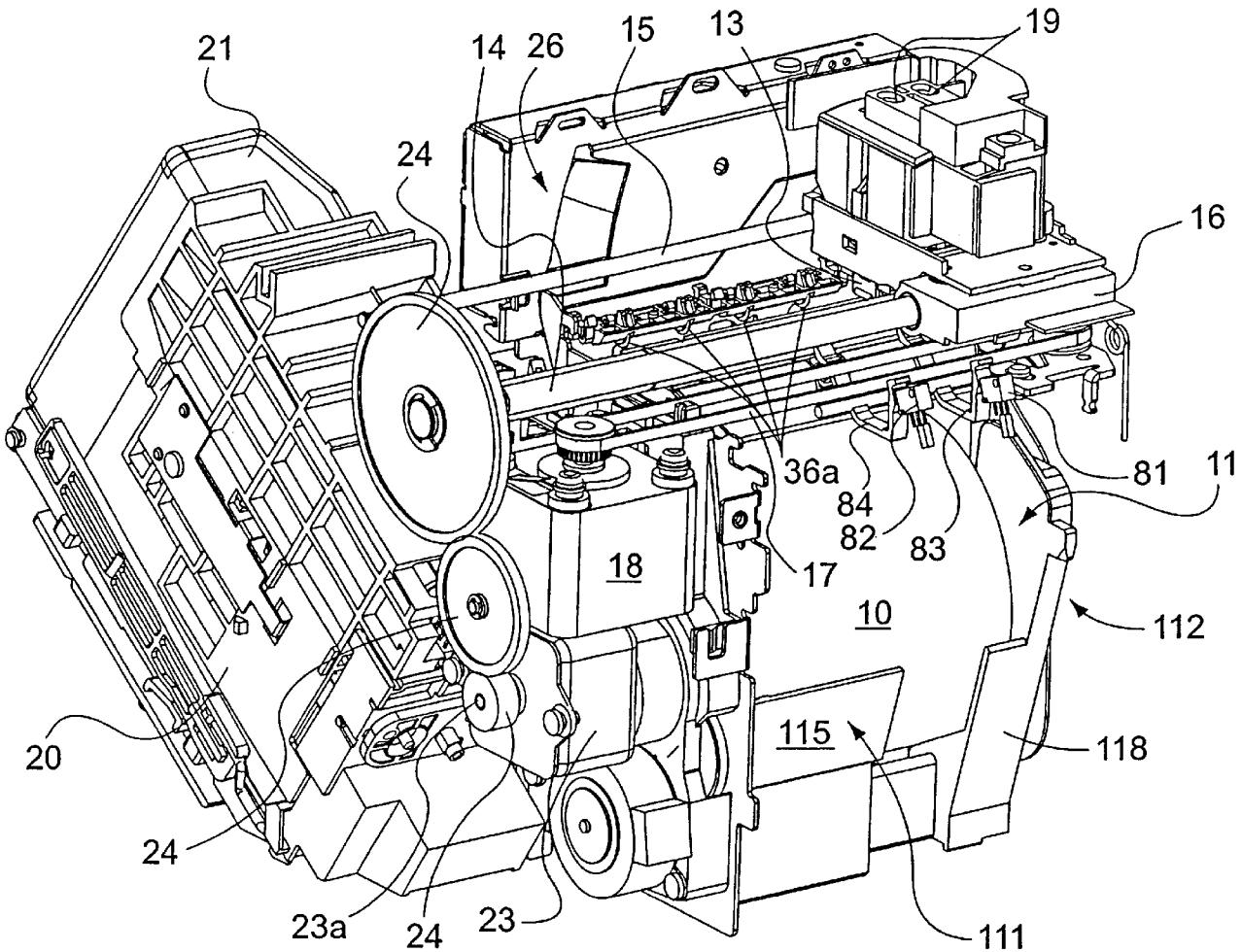
FIG. 4 is a rear side perspective view of the roll paper printer in the same state as in FIG. 3.
Figure 5:
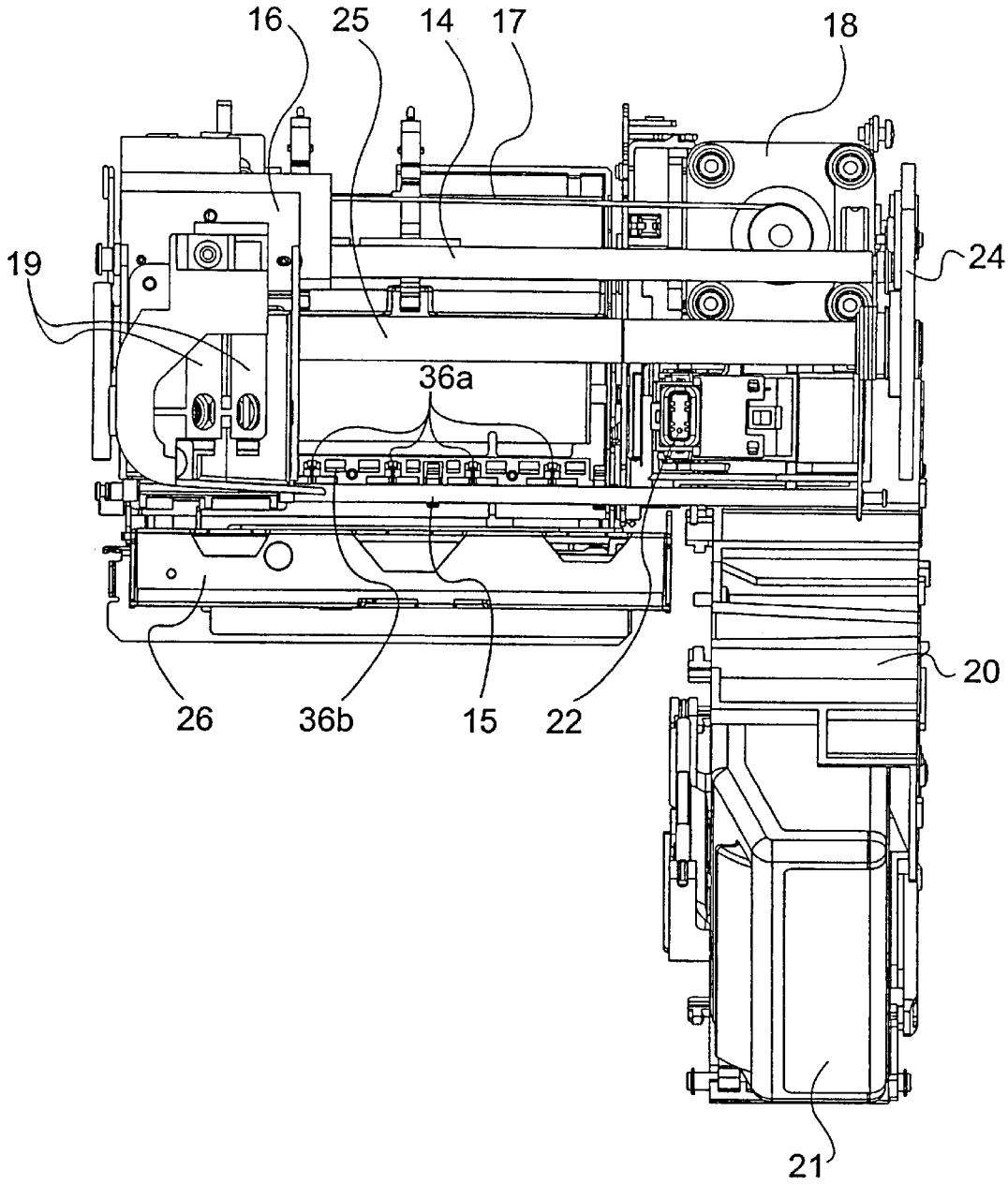
FIG. 5 is a plan view of the roll paper printer in the same state as in FIG. 3.
Figure 6:
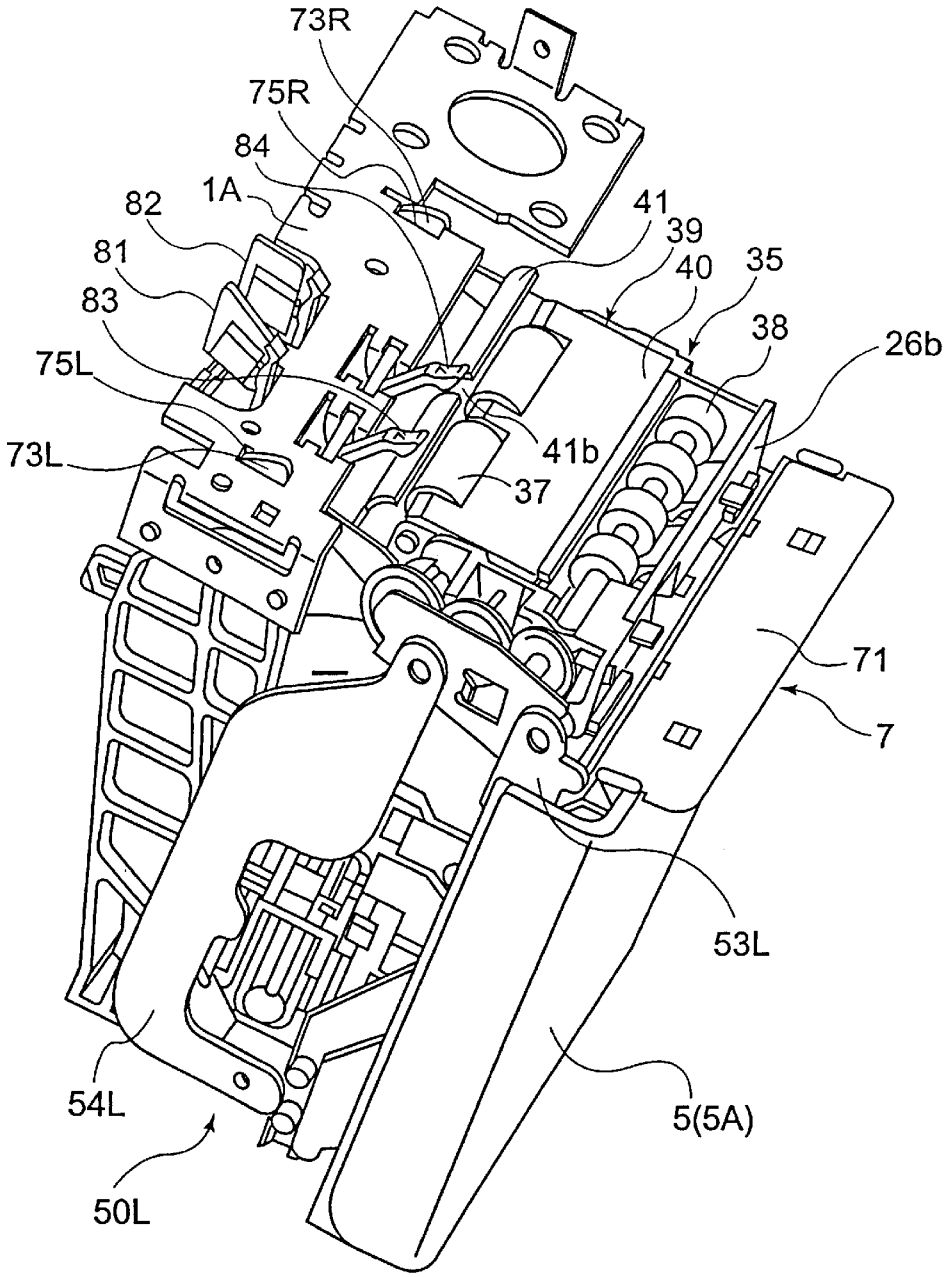
FIG. 6 is a partial perspective view omitting the component parts located above the discharge port in the roll paper printer in the same state as in FIG. 3.
Figure 7:
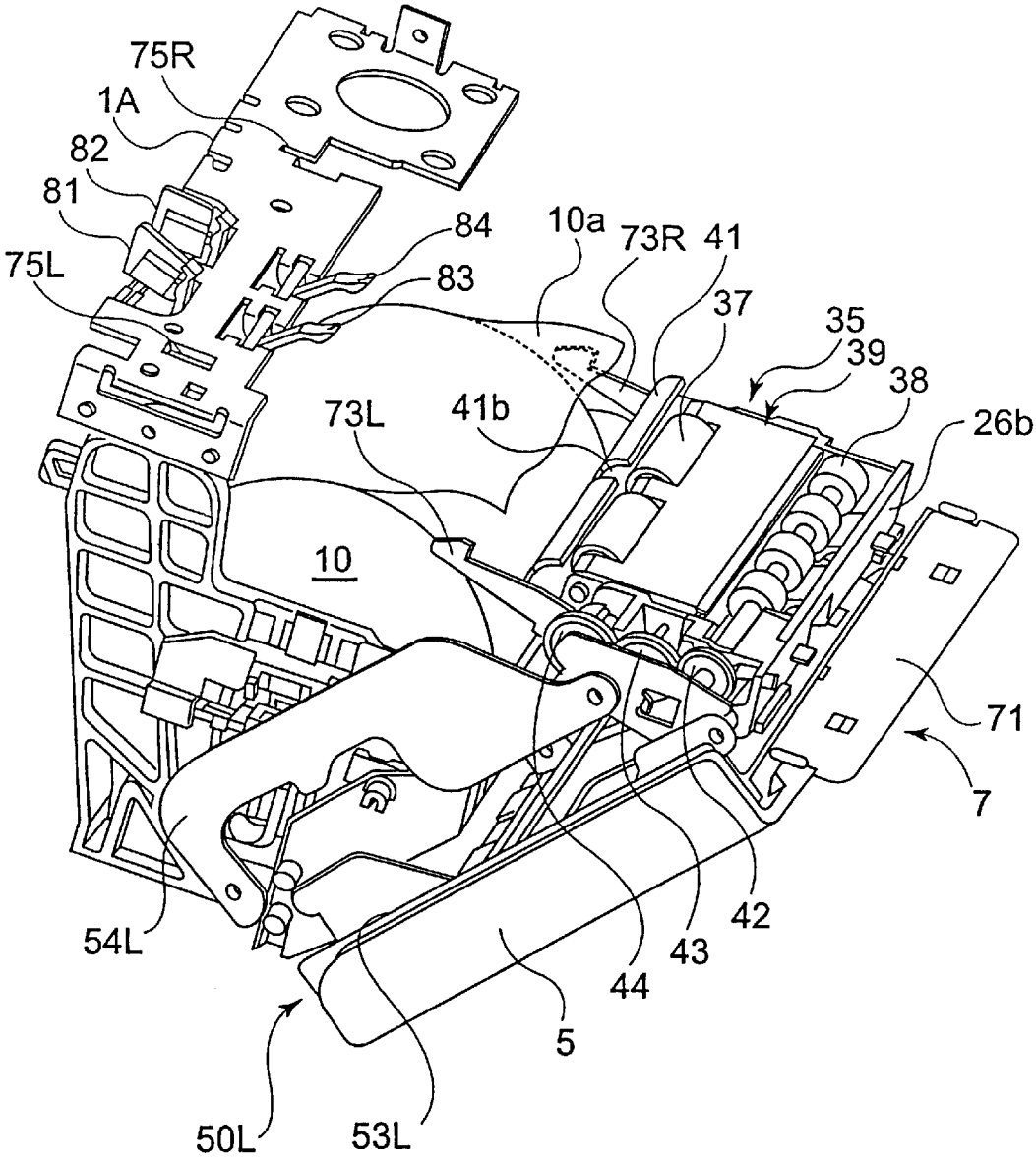
FIG. 7 is a partial perspective view in which the cover is semi-opened from the state shown in FIG. 6.

FIG. 3 is a front side perspective view showing the internal structure of the roll paper printer 1 in a state in which the exterior case 2, the operating knob 8 of the operating lever 7 and the discharge table 9 are removed; FIG. 4 is a rear side perspective view of the roll paper printer 1 in the same state; FIG. 5 is a plan view of the roll paper printer 1 in the same state; FIG. 6 is a partial perspective view omitting the component parts located above the discharge port 6 in the roll paper printer 1 in the state shown in FIG. 3; and FIG. 7 is a partial perspective view in a case where the cover 5 is semi-opened from the state shown in FIG. 6.

The following description will be made with reference to these drawings. In the roll paper printer of this embodiment, a paper transfer mechanism described later for transferring a recording sheet 10*a* delivered from a recording paper roll 10 housed in a roll paper housing 11 is incorporated at a position above the roll paper housing 11 formed at the lower end of the main body frame 1A. An ink-jet head 13 directed downward conducts printing onto the upper surface of the recording sheet 10*a* transferred to the discharge port 6 by the paper transfer mechanism. The ink-jet head 13 is mounted on a carriage 16 reciprocating along a main guide shaft 14 and a sub-guide shaft 15 arranged in the width direction of the printer. The carriage 16 is connected to a timing belt 17 stretched in the width direction of the printer. The timing belt 17 is driven by a carriage motor 18.

A pressure dumper 19 is mounted on the carriage 16, and the ink is supplied to the ink-jet head 13 from an ink cartridge 21 detachably attached to a cartridge holder 20 via an ink tube not shown and the pressure dumper 19. A head cap 22 for head maintenance is arranged at a position off the printing area within the reciprocating range of the ink-jet head 13, i.e., at the end position on the cartridge holder-side in this embodiment so that maintenance is carried out by moving the ink-jet head 13 to that position by a known operation.

As is well understood from FIG. 4, a paper feed motor 23 is arranged immediately below the carriage motor 18, and a motor output shaft 23*a* is connected to a paper feed roller 25 which is a component part of the paper feed mechanism described later via a reducing gear train 24 comprising three gears. The paper feed roller 25 rotates by a driving force of the paper feed motor 23, and the recording sheet 10*a* delivered from the recording paper roll 10 housed in the roll paper housing 11 passes through the printing position by the paper feed roller 25 and printed by the ink-jet head 13. While being printed, the recording sheet 10*a* is discharged to outside from the discharge port 6. An auto-cutter 26 for automatically cutting the recording sheet 10*a* is arranged directly above this discharge port 6 to automatically cut the recording sheet 10*a* after printing into prescribed lengths.

Opening/Closing Mechanism of Cover

Figure 8:
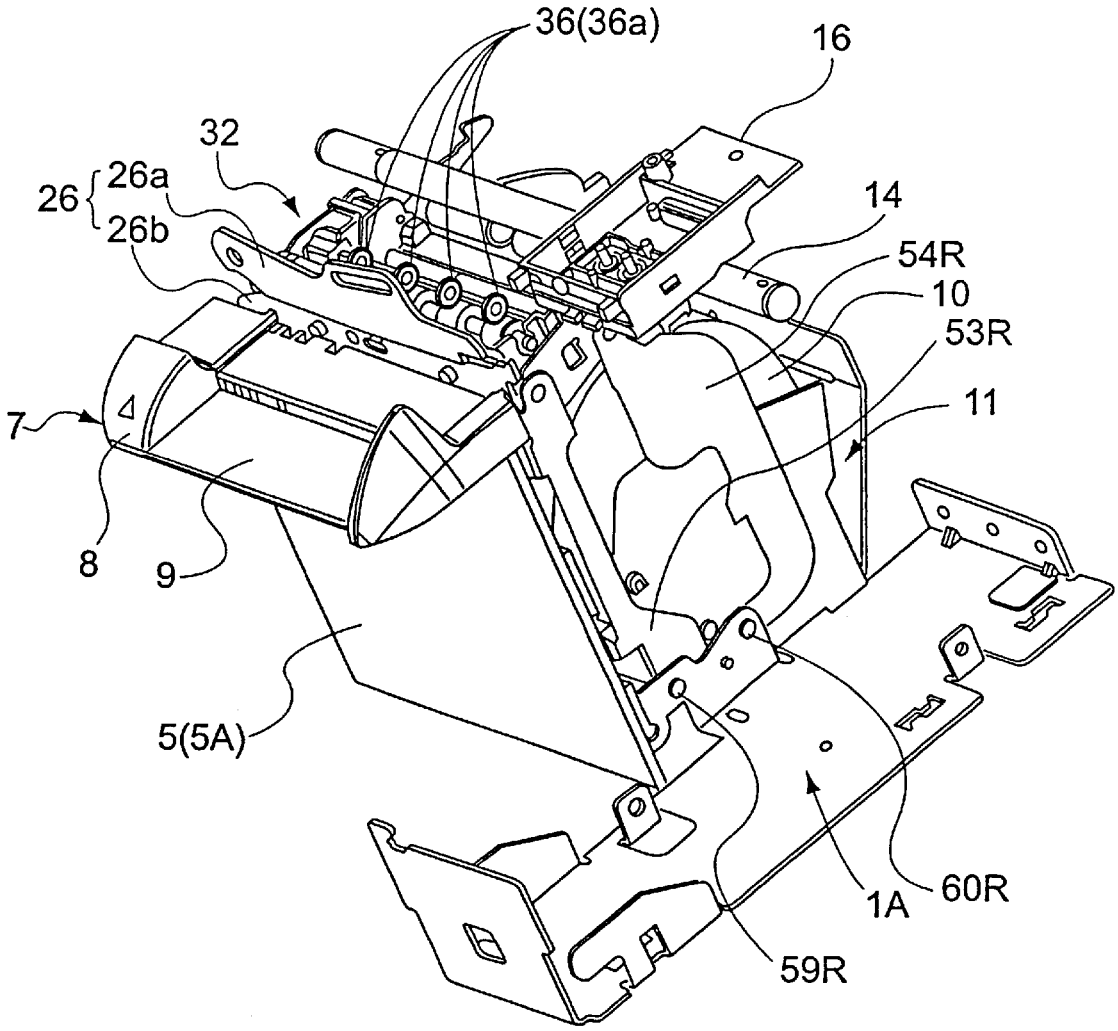
FIG. 8 is a perspective view of the parts relating to opening and closing of the cover in the roll paper printer shown in FIG. 1.
Figure 9A:
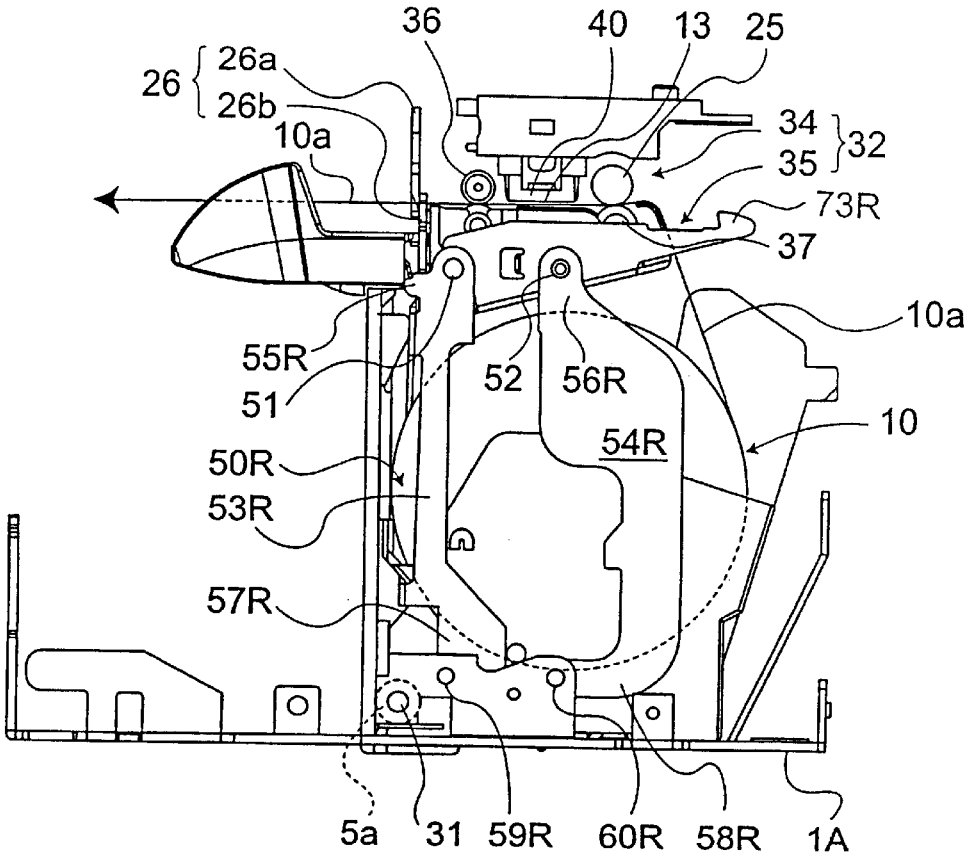
FIG. 9A is a right side view of the portion shown in FIG. 8.
Figure 9B:
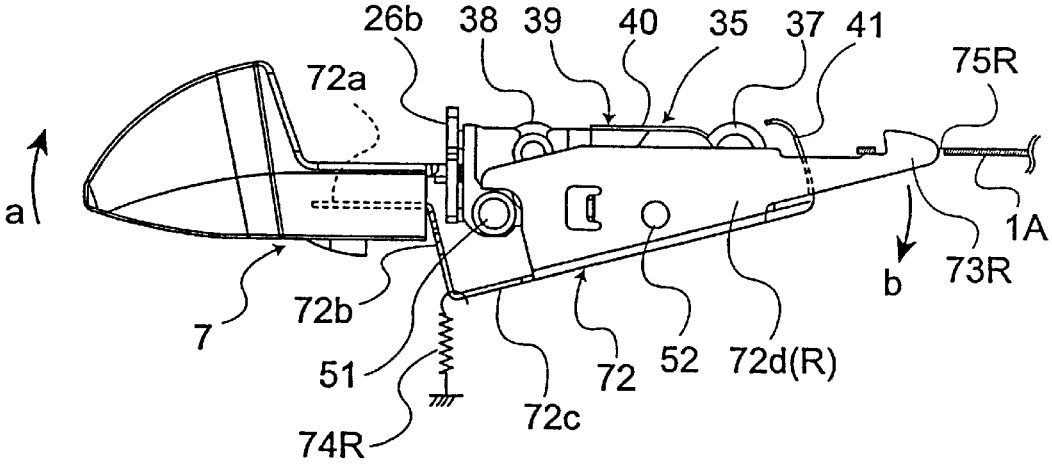
FIG. 9B is a partial side view of FIG. 9A.
Figure 9C:
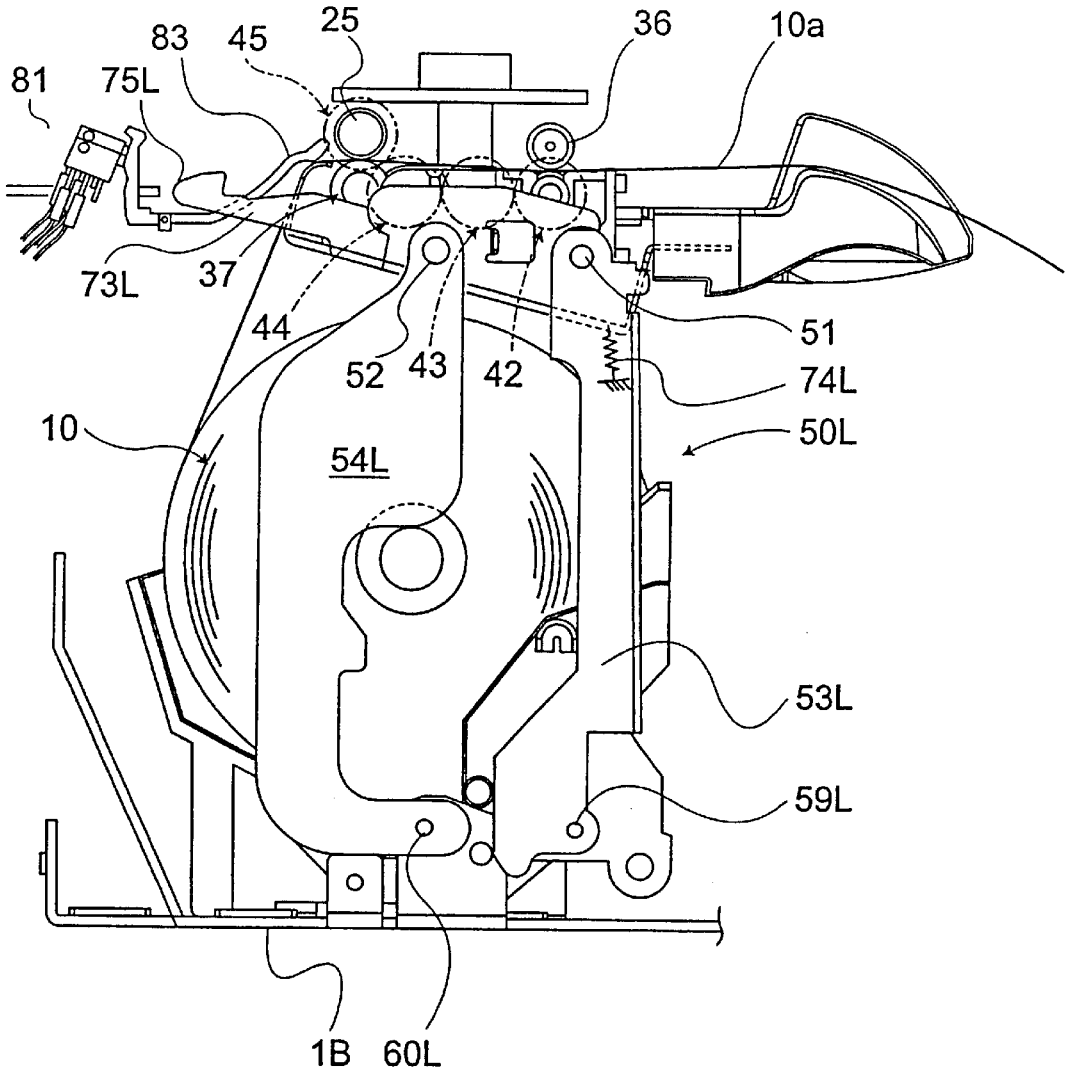
FIG. 9C is a left side view of the portion shown in FIG. 8.
Figure 10:
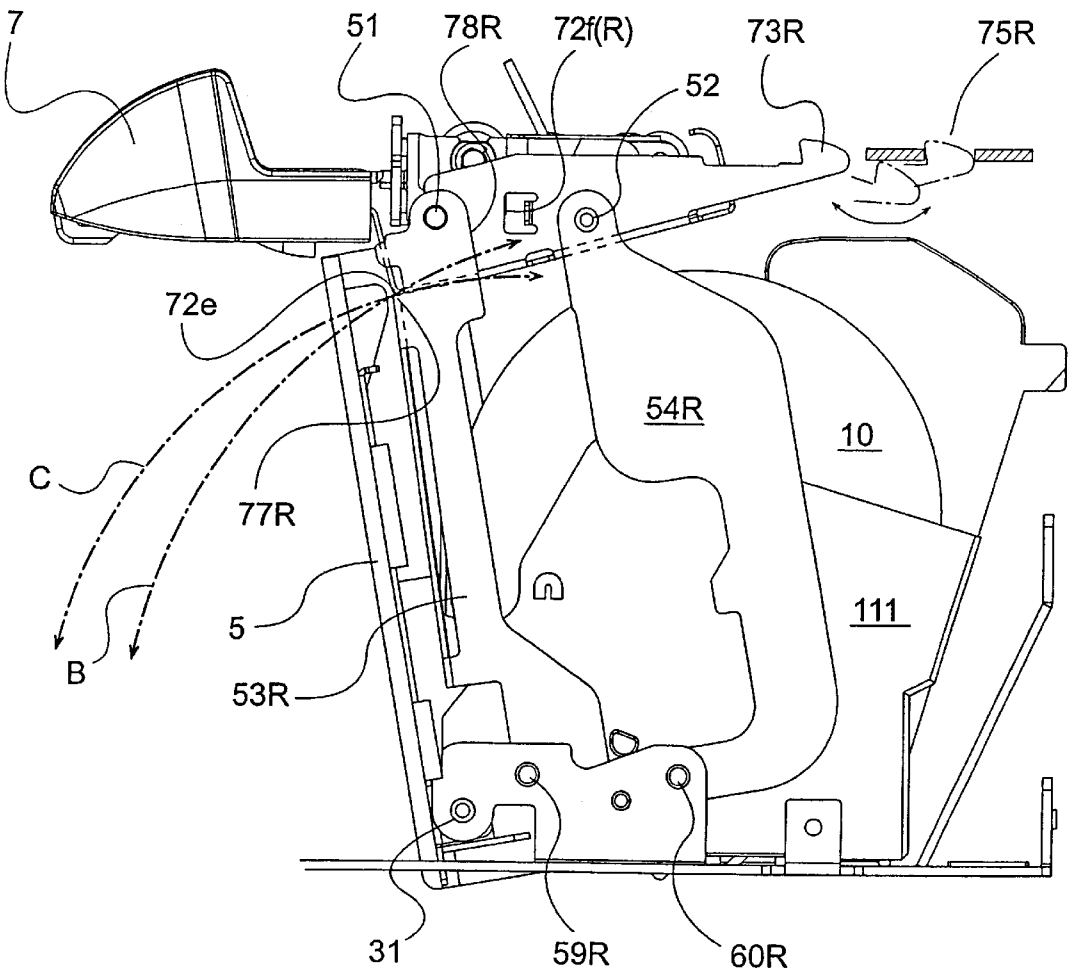
FIG. 10 is a right side view showing the state immediately after unlocking of the cover in the roll paper printer in the state shown in FIG. 8.
Figure 11:
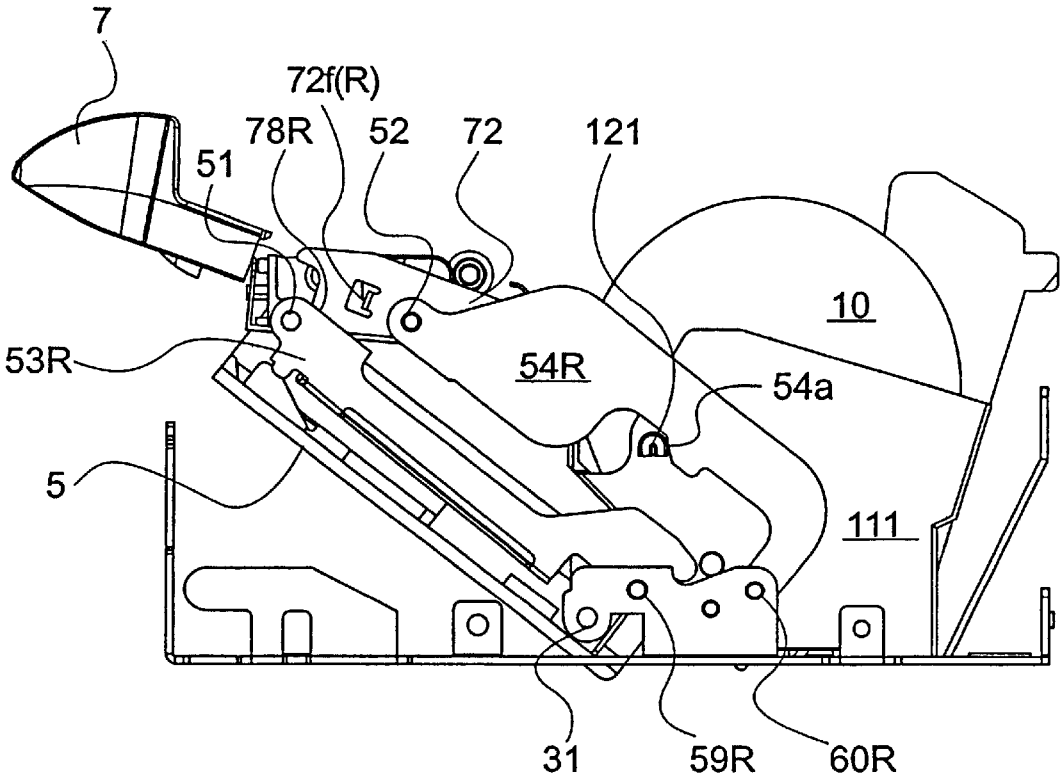
FIG. 11 is a right side view showing the roll paper printer, of which the cover is semi-opened as in the case shown in FIG. 7.
Figure 12:
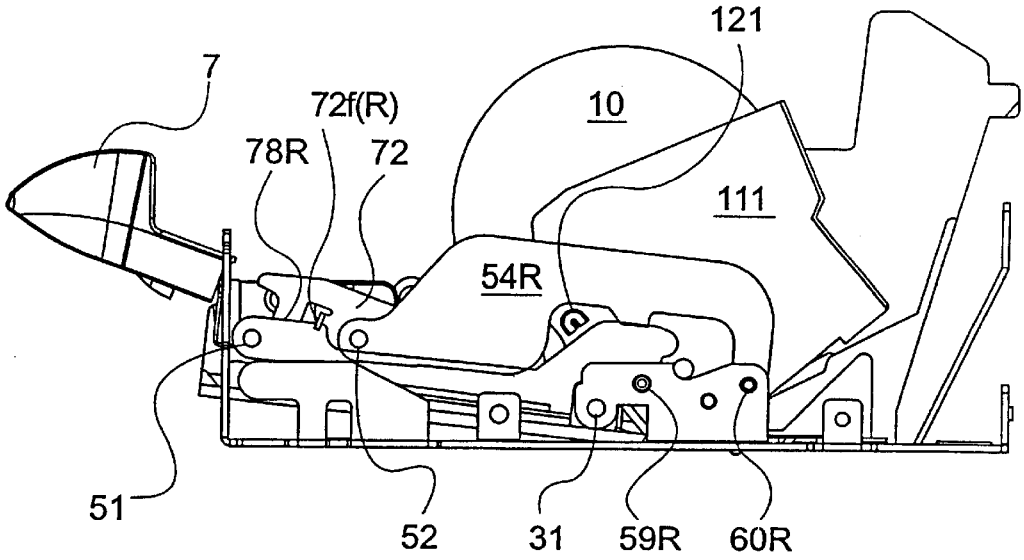
FIG. 12 is a right side view of the state in which the cover of the roll paper printer is fully opened.
Figure 13:
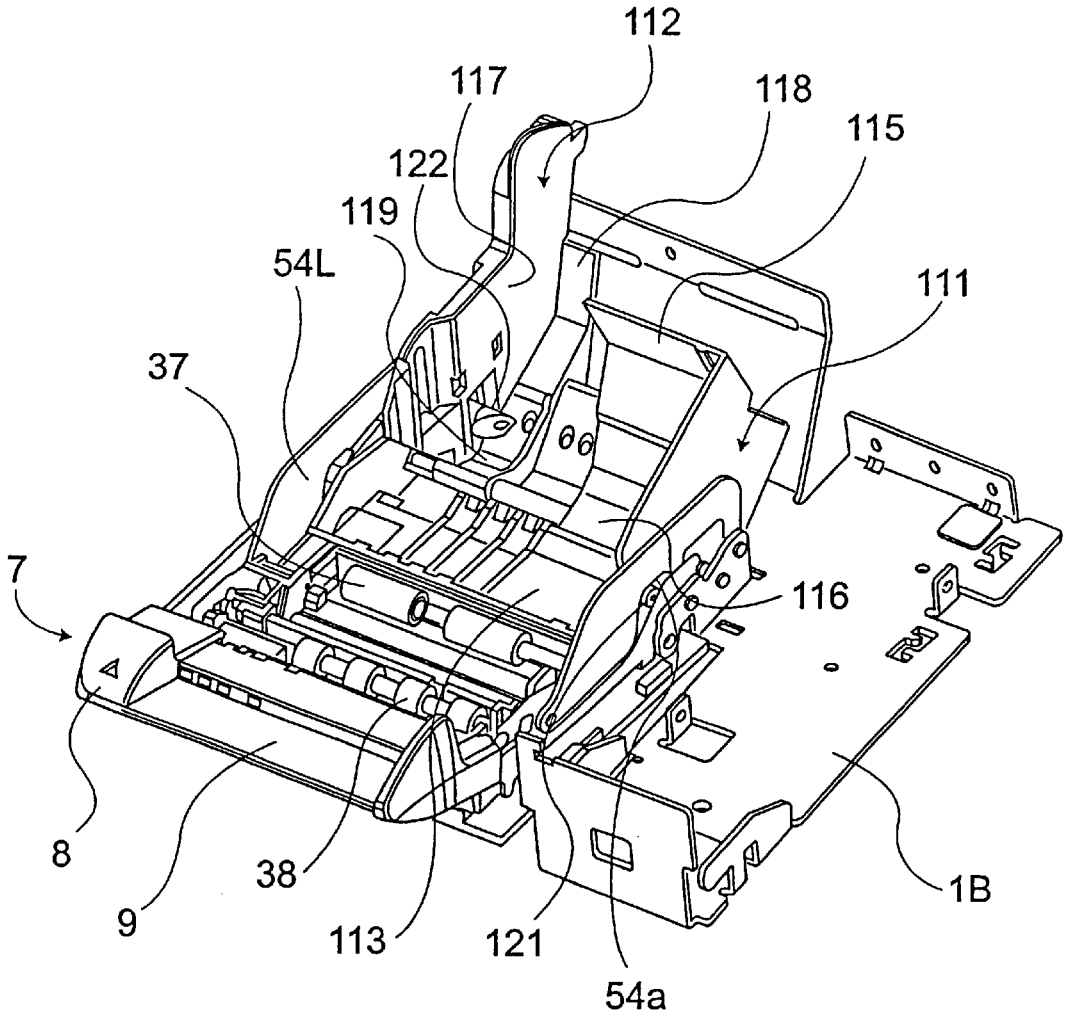
FIG. 13 is a partial perspective view showing the roll paper charging section in the state shown in FIG. 12.

FIG. 8 is a perspective view showing portions relating to opening/closing of the cover 5 in the roll paper printer 1 of this embodiment; FIG. 9A is a right side view thereof; FIG. 9B is a partial side view thereof; FIG. 9C is a left side view thereof; FIG. 10 is a right side view showing the unlocked cover 5 of the roll paper printer 1; FIG. 11 is a right side view of a case where the cover 5 of the roll paper printer 1 of this embodiment is semi-opened as in the case shown in FIG. 7; FIG. 12 is a right side view of a state in which the cover 5 is fully opened; and FIG. 13 is a partial perspective view showing the roll paper charging section in the same state.

First, the invention will be described mainly with reference to FIGS. 8 to 10. The cover 5 opening and closing the roll paper housing 11 constitutes a part of the printer front portion of the exterior case 2. Right and left brackets 5*a* attached to the back of the lower end of the cover 5 are supported rotatably forward and backward with the right and left pins 31 attached to the main body frame 1A as centers.

In the roll paper printer 1 of this embodiment, the overall configuration and operations of the mechanism for opening and closing the cover 5 are as follows. As described later, the cover 5 is opened and closed integrally with right and left sets of parallel linking mechanism forming a four-node link mechanism. A movable-side paper feed mechanism section of the paper feed mechanism is supported on the upper end of the parallel linking mechanism, and the aforementioned operating lever 7 is attached to the movable-side paper feed mechanism section. Lock by the locking mechanism is released by operating the operating lever 7. By pulling the operating lever 7 toward the operator after unlocking, the movable-side paper feed mechanism section is moved forward by the parallel linking mechanism while keeping the same posture, and the cover 5 opens along with this.

Paper Feed Mechanism

As shown in FIGS. 8 to 10, the paper feed mechanism 32 has a fixed-side paper feed mechanism 34 located above the transferred recording sheet 10*a* , and a movable-side paper feed mechanism 35 located under the recording sheet 10*a*. The fixed-side paper feed mechanism 34 comprises a paper feed roller 25 (first roller) to which a driving force is transferred from the paper feed motor 23, and a discharge-side follower roller 36 (second roller). These rollers are installed on the main body frame 1A so as to be horizontal in the printer width direction substantially at a uniform height. The paper feed roller 25 is arranged in the upstream of the ink-jet head 13 in the recording sheet transfer direction, i.e., at the rear side of the printer, and the follower roller 36 is arranged at the front side of the printer which is in the downstream of the ink-jet head 13 in the recording sheet transfer direction.

The movable-side paper feed mechanism 35 comprises a follower roller 37 (third roller) pressed by a spring force from below against the paper feed roller 25, and a discharge-side driven roller 38 (fourth roller) in contact from below with the follower roller 36. The movable-side paper feed mechanism 35 further comprises a platen member 39 having an upper surface arranged horizontally between the rollers 37 and 38, and a movable guide 41 arranged behind the follower roller 37 arranged in the upstream in the recording sheet transfer direction.

The horizontal upper surface of the platen member 39 faces the ink nozzle surface of the ink-jet head 13 with a constant gap, and defines a printing position 40 of the ink-jet head 13. The movable guide 41 is a guide for directing the recording sheet 10*a* delivered from the recording paper roll 10 of the roll paper housing 11 to the nip portions of the paper feed roller 25 and the follower roller 37.

The discharge-side driven roller 38 is connected to a gear train comprising gears 42, 43 and 44 attached rotatably to the movable-side paper feed mechanism section 35 (see FIG. 7). In the closed state of the cover 5, the gear 44 (follower gear) engages with a driven gear 45 formed at the end of the paper feed roller 25 of the fixed-side paper feed mechanism section 34 (see FIG. 9C). It is therefore rotation-driven by the driving force of the paper feed motor 23.

The reducing ratio by the gears 42 to 44 is adjusted, so that the rotation speed of the discharge-side driven roller 38 is slightly higher than the rotation speed of the paper feed roller 25. As a result, it is possible to impart a slight tension to the recording sheet 10*a* passing the printing position 40, and hence to set an appropriate gap between the ink-jet head 13 and the recording surface of the recording sheet 10*a*.

The paper discharge-side follower roller 36 has a configuration in which a plurality of disk rollers are coaxially attached to the rotation shaft 36*b* with a constant gap, and the disk rollers 36*a* have a sharp periphery. In this embodiment, the rotation shaft 36*a* is formed from a coil spring. Therefore, the peripheral surfaces of the disk rollers 36*a* are in contact with the printing surface of the recording sheet 10*a* with slight contact areas.

The rollers 36*a* come into contact with the printing surface of the recording sheet 10*a* after printing. However, because the contact area between the recording surface and the disk roller 36*a* is slight under a slight contact pressure, it is possible to avoid troubles of a print quality reduced by the ink immediately after printing rubbed by the rollers 36*a* or contamination of the recorded surface with ink.

In this embodiment, the first and fourth rollers are driven rollers to which the driving force from the motor is transferred, while the second and third ones are follower rollers. However, either one of the first and third rollers, which come in contact with each other when the movable-side paper feed mechanism is at operating position, may be the driven roller, and the other one the follower roller. Likewise, either one of the second and fourth rollers may be the driven roller and the other the follower roller. For example, the first and fourth rollers may be the follower ones and the second and third rollers the driven ones.

Parallel Linking Mechanism

As shown in FIGS. 8 and 9A to 9C, rollers 37 and 38 of the movable-side paper feed mechanism section 36 are attached to a platen member 39, and the platen member 39 is supported on upper ends of the right and left sets of parallel linking mechanism 50L and 50R.

One of the parallel linking mechanisms 50R has a front/back pair of swinging arms 53R and 54R extending vertically. These upper ends 55R and 56R are hinge-connected rotatably in the forward/backward direction to the right ends of a front/back pair of parallel supporting shafts 51 and 52 horizontally installed at a uniform height in the printer width direction on the platen member 39. The lower ends 57R and 58R of these swinging arms 53R and 54R are similarly hinge-connected rotatably in the forward/backward direction to a front/back pair of supporting shafts 59R and 60R attached at a uniform height to the main body frame 1A.

The four-node parallel linking mechanism 50R comprises, as described above, the platen member 39 of the movable-side paper feed mechanism section 35, the supporting shafts 51, 52, 59R and 60R and the pair of swinging arms 53R and 54R. The other parallel linking mechanism 50L has the same structure as above comprising the platen member 39, the supporting shafts 51, 52, 59L and 60L, and the pair of swinging arms 53L and 54L. By pulling the platen member 39 supported by these parallel linking mechanisms 50R and 50L toward the operator, the platen member 39 moves forward and downward while keeping the posture.

The fixed edge 26*b* of the auto-cutter 26 is attached to a position of the platen member 39 on the printer front end side, while the movable edge 26 thereof is fixed to the main body frame 1A side.

Operating Lever, Locking Mechanism

The operating lever 7 and the locking mechanism for locking the movable-side paper feed mechanism section 35 (cover 5) will now be described with reference to FIGS. 8 to 10. As is clear from FIG. 9B, the operating lever 7 comprises a lever body 71 formed integrally with the operating knob 8 and the discharge table 9, a lever supporting member 72 to which the lever body 71 is attached, and locking hooks 73L and 73R formed on the both ends on the printer rear end side of the lever supporting member 72. The lever supporting member 72 comprises a horizontally extending lever body supporting plate portion 72*a* , a fixed edge cover plate portion 72*b* which is folded downward to the printer rear side from the portion 72*a* here and extends from the front to directly below the cutter fixed edge 26*b* , and a coupling plate portion 72*c* extending while slightly inclining upward toward the back of the printer immediately following the fixed edge cover plate portion 72. The rear end portion of this coupling plate portion 72*c* is folded upward, and the movable guide 41 is integrally formed therewith.

The both end portions of the coupling plate portion 72*c* in the printer width direction form brackets 72*d*(L) and 72*d*(R) folded upward at right angles. Hooks 73L and 73R are formed on the extension toward the back of the printer of these brackets 72*d*(L) and 72*d*(R). The both ends of the supporting shaft 52 rotatably passing through the platen member 39 similarly rotatably pass through middle positions in the forward/backward direction of the both brackets 72*d*(L) and 72*d*(R).

The operating lever 7 having the above-mentioned configuration is always pulled diagonally downward by a pair of coil springs 74R and 74L of which the lower ends are attached to the cover 5, at the both end portions on the printer front side relative to the supporting shaft 52 serving as the rotation center of the operating lever 7. Engaging claws 73*a* of the hooks 73L and 73R positioned at the rear end of the operating lever 7 are engaged from below with the printer rear end-side surfaces of a pair of left and right hook engaging grooves 75L and 75R formed on the main body frame 1A by the action of the spring force of these coil springs 74R and 75R (see FIGS. 6 and 7). By pushing up the lever body 71 of the operating lever 7 in the arrow "a" direction against the spring force, the hook engaging claws 73a of the hooks 73L and 73R can be released from the hook engaging groove 75. FIG. 10 illustrates a state immediately after coming-off of the hook 73R.

In contrast, when the operating lever 7 in the state shown in FIG. 10 is pressed toward the back of the printer, the hook engaging claw 73*a* of the hook 73R moves downward around the supporting shaft 52 against the spring force, crosses over the lower surface of the hook engaging groove 75R, and is fitted from below into the hook engaging groove 75R, thereby transferring into the locked state.

The locking mechanism for locking the movable-side paper feed mechanism 35 at the operating position 35A is thus composed of the hooks 73L and 73R, the hook engaging groove 75L and 75R, and the coil springs 74L and 74R.

The upper end portion of the cover 5 enclosing the roll paper housing 11 is always pressed by the pair of left and right coil springs 74L and 74R against the front side swinging arms 53R a 53L. The cover 5 therefore rotates forward and backward integrally with the swinging arms 53R and 53L. More specifically, when the movable-side paper feed mechanism 35 supported by the swinging arms 53R and 53L is moved to the operating position 35A, the cover 5 as well moves to the closed position 5A in linkage therewith. In order to open the cover 5 to the full-open position 5B, on the contrary, it suffices to unlock by operating the operating lever 7, and pull the operating lever 7 toward the operator.

Operation of Movable Guide

The movable guide 41 is integrally formed at the rear end of the lever supporting member 72 of the operating lever 7. By rotating the operating lever 7 around the supporting shaft 52, therefore, the movable guide 41 also moves up and down around the supporting shaft 52. Operations of the movable guide 41 will now be described with reference mainly to FIGS. 14A to 14C.

In a state in which the cover 5 is at the closed position 5A, i.e., when the movable-side paper feed mechanism section 35 is at the operating position 35A, the follower roller 37 is in contact from directly below with the paper feed roller 25, as described above. The tangential line H drawn at the contact points of these rollers is substantially horizontal and substantially agrees with the moving direction of the movable-side paper feed mechanism section 35 (arrow x direction) when the cover 5 is open. A curved guide surface 41*a* curving toward the nip portions of the rollers 25 and 37 is formed at the upper end of the movable guide 41, and the highest position of the curved guide surface is at a position higher than the nip portions of the rollers 25 and 37. In other words, the position is closer to the driving-side paper feed roller 25 than the tangential line H.

As a result, the recording sheet 10*a* directed by the guide surface 41*a* of the movable guide 41 to the roller nip portions is directed from the side of the paper feed roller 25 diagonally to the nip portions of the rollers 25 and 37. As compared with the case where the recording sheet is introduced to the roller nip portions from the same height, it is possible to set a larger winding angle of the recording sheet 10*a* relative to the paper feed roller 25. As a result, it is possible to accomplish transfer of the recording sheet 10*a* in a state free from slip.

Figure 14A:
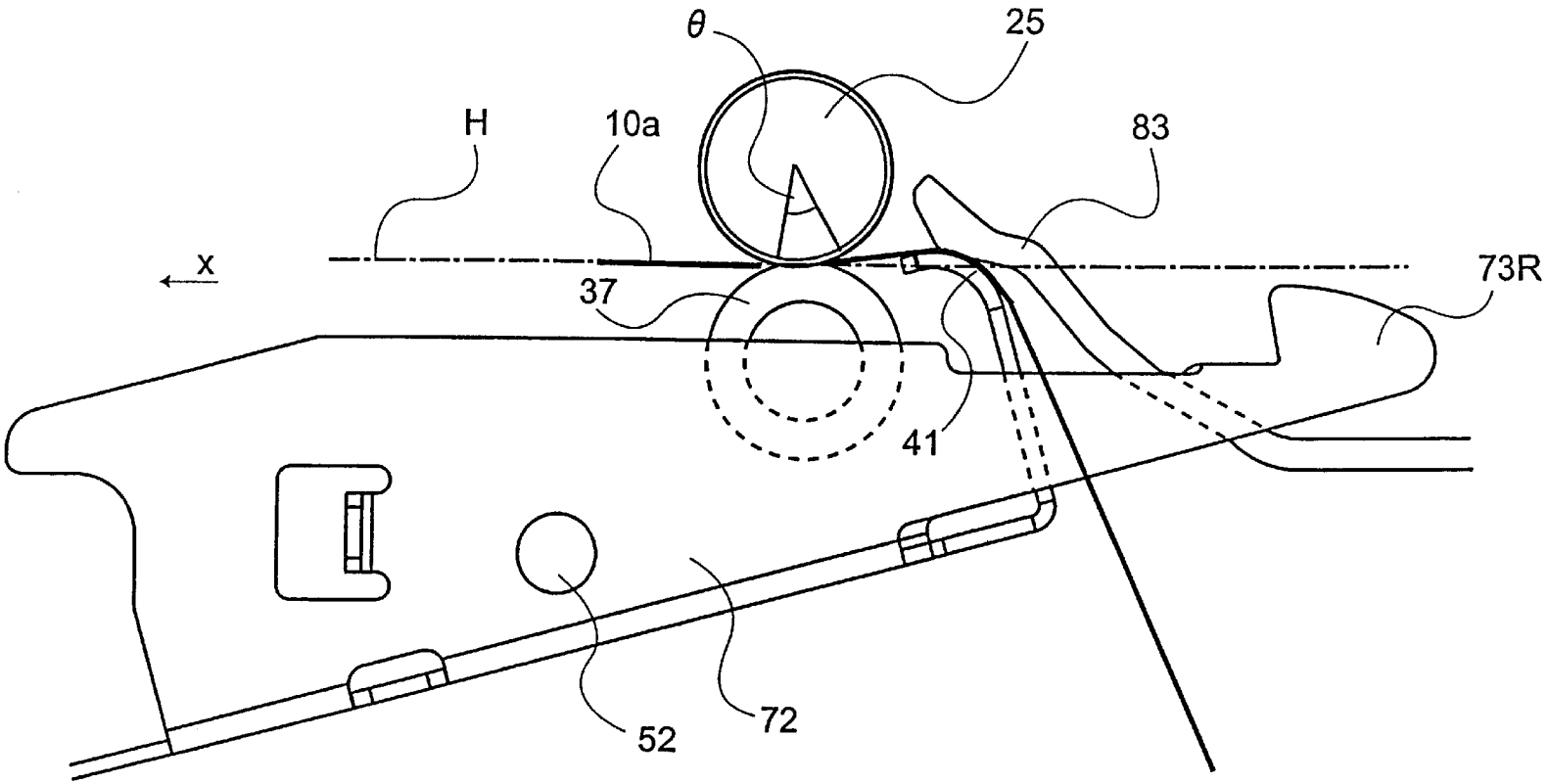
FIGS. 14A to 14C are descriptive views showing operations of the movable guide formed on the operating lever.
Figure 14B:
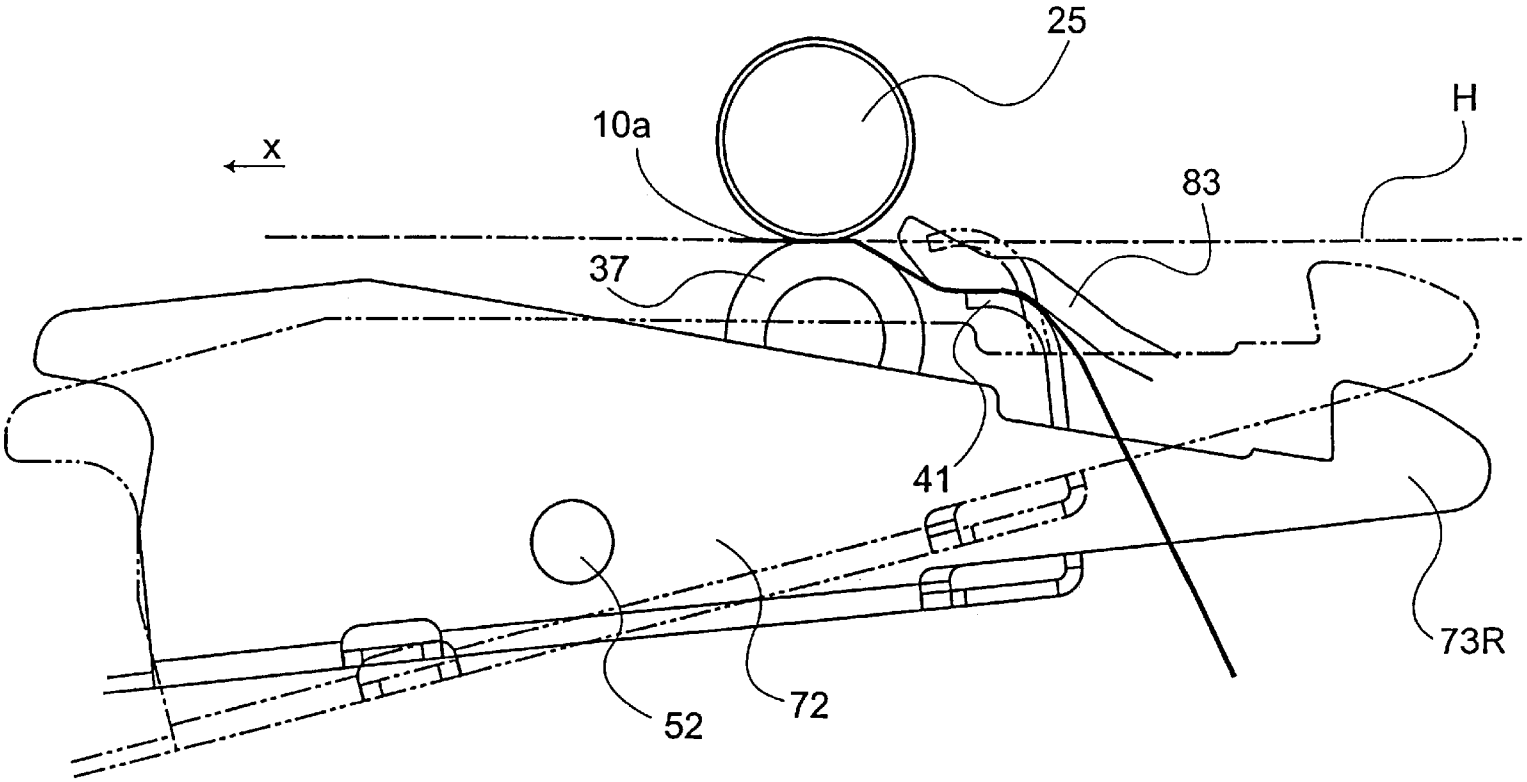

FIG. 14B shows a state in which the operating lever 7 is lifted and locking by the locking mechanism is released to open the cover 5. When the operating lever 7 is lifted, the movable guide 41 positioned behind the supporting shaft 52 moves downward. The highest position of the guide surface 41*a* of the movable guide 41 when engagement of the hooks 73L and 73R has just been released is set to be lower than the nip portions of the paper feed roller 25 and the follower roller 37.

Figure 14C:
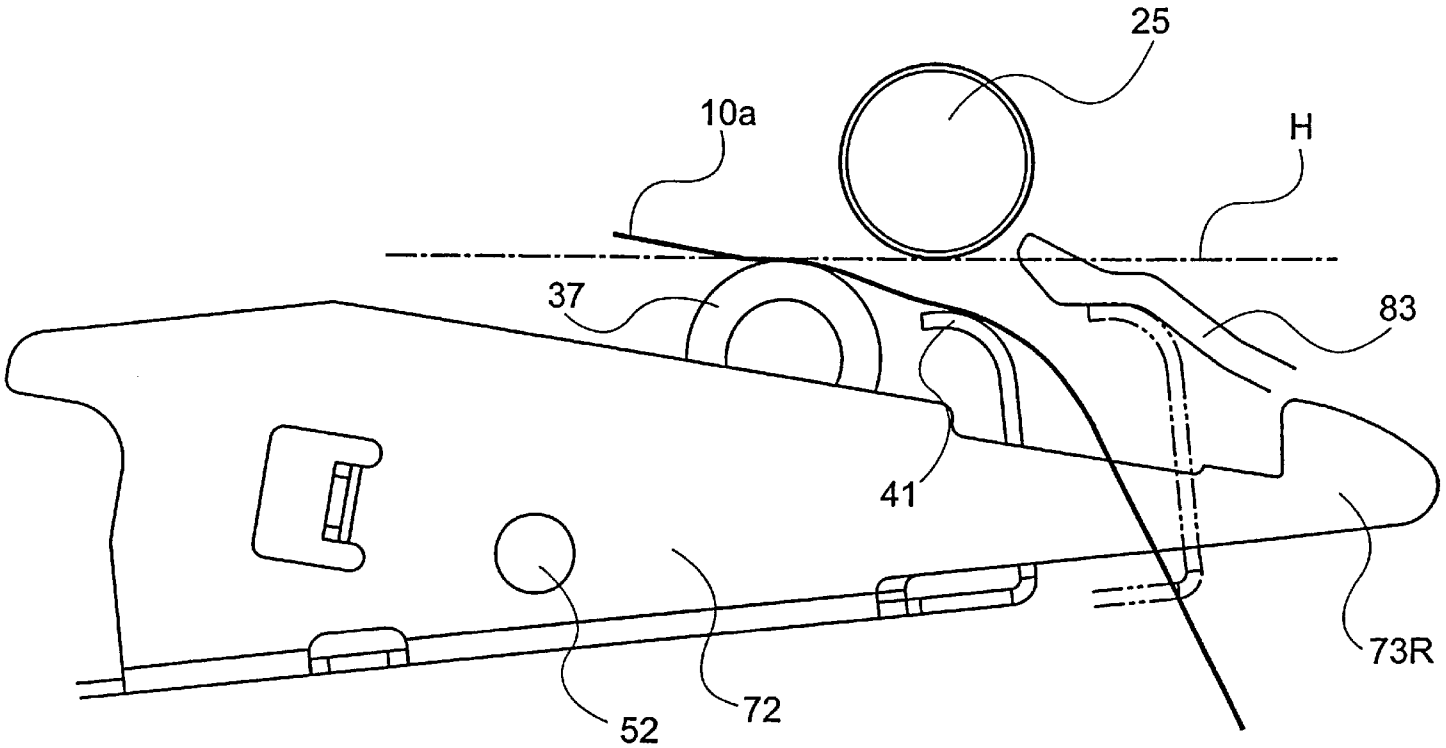

As a result, when opening the cover 5 by pulling the operating lever 7 toward the operator after unlocking, the movable guide 41 is at a position lower than the paper feed roller 25 of the fixed-side paper feed mechanism section 34. Therefore, as shown in FIG. 14C, even when the movable-side paper feed mechanism section 35 moves substantially horizontally toward this side, the movable guide 41 never comes into contact with the paper feed roller 25. The movable guide 41 shown in FIG. 14C represents a case in the state shown in FIG. 10.

Operating Lever Rotating Mechanism

Two operating lever rotating mechanisms are provided for rotation of the operating lever in linkage with the operation thereof in this embodiment. A first operating lever rotating mechanism will be described. Operation assistants 77R and 77L (engaging sections) capable of pushing up the operating lever 7 from below in response to the rotating position are formed on the front side of the upper ends of the swinging arms 53R and 53L. More particularly, as shown in FIG. 10, the operation assistants 77R and 77L draw a locus represented by a one-point chain line B around the supporting shaft 59R. In contrast, a corner portion 73*e* at the lower end of the fixed edge cover plate portion 72*b* of the operating lever 7, moving while being supported by the four-node parallel linking mechanisms 50R and 50L, draws a locus having a radius of curvature smaller than the locus B.

In this embodiment, these loci B and C cross each other at a rotating position shown in FIG. 10 in which the cover 5 rises up at a position slightly before the closed position 5A (state shown in FIGS. 9A and 9C) of the cover 5, and subsequently, the operation assistants 77R and 77L push the corner portion 73*e* of the operating lever 7 from below. Because the front side of the supporting shaft 52 is pushed up, the operating lever 7 moves toward the closed position shown in FIGS. 9A and 9C while the hook 73 formed on the rear side moves down. Immediately before reaching the closed position, the operation assistants 77R and 77L come off the corner portion 73*e* of the operating lever 7. The front side of the operating lever 7 therefore moves down under the effect of the spring force of the coil springs 74L and 74R.

As described above, the hooks 73L and 73R of the operating lever 7 moves from a position 73A represented by a solid line in FIG. 10 through a position 73B represented by an imaginary line to a locking position 73C represented by another imaginary line. The operating force moving the hooks 73L and 73R to the position 73B against the spring force is reduced by a force of the operation assistants 77R and 77L of the swinging arms 53R and 53L of pushing up the operating lever corner portion 73*e*. According to this embodiment, therefore, only a small operating force is required for locking the cover 5 at the closed position 5A, thus permitting improvement of operability for opening and closing the cover 5.

In this configuration, the front side portion of the operating lever 7 of this embodiment rotates upward even during operation for opening the cover 5. A second operating lever rotating mechanism provided for this purpose comprises engagement projections 72*f*(L) and 72*f*(R) formed on the left bracket 72*d*(L) and the right bracket 72*d*(R) of the operating lever 7, and contact surfaces 78L and 78R serving as engaged sections formed on a part of the rear side end face of the upper end portions of the front side left and right swinging arms 50L and 50R.

Forming positions of these engagement projections and contact surfaces are set so as to ensure the following operations. When tilting the swinging arms 53L and 53R toward the front of the printer by a prescribed angle, the engagement projections 72f*f*(L) and 72*f*(R) of the operating lever 7 come into contact with the contact surfaces of the swinging arms 53L and 53R. Furthermore, when tilting the swinging arms 53L and 53R toward the printer front, the engagement projections 72*f*(L) and 72*f*(R) are relatively pushed up by the contact surfaces 78L and 78R. When the engagement projections 72*f*(L) and 72*f*(R) are pushed up, the front side portion of the operating lever 7 having the projections 72*f*(L) and 72*f*(R) formed thereon rotates around the supporting shaft 52.

With the cover 5 fully opened, therefore, the operating lever 7 is directed diagonally upward, so that there is a sufficiently wide gap under the leading end portion thereof. Upon closing the cover 5, it is possible to easily insert a finger under the leading end portion of the operating lever 7 and lift the operating lever, hence permitting the closing operation of the cover 5 with a high operability.

Movable Guide Detecting Mechanism, Recording Sheet Detecting Mechanism

The printer 1 of this embodiment is provided with a microswitch for detecting the movable guide 41 for the purpose of detecting whether or not the cover 5 of the roll paper housing 11 is closed and the movable-side paper feed mechanism section 35 is positioned at the operating position thereof. It is provided with another microswitch for detecting whether or not the recording sheet 10*a* is drawn out on the discharge port 6 side, running between the fixed-side paper feed mechanism section 34 and the movable-side paper feed mechanism section 35.

This will now be described with reference to FIGS. 5, 7, 9C, and 14A to 14C. Microswitches 81 and 82 and swinging levers 83 and 84 serving as detecting elements thereof are attached to the main body frame 1A. A downward force is always imparted by a force imparting member (not shown) such as a torsion spring to the swinging levers 83 and 84. When the movable-side paper feed mechanism section 35 is at the operating position, as shown in FIG. 6, the swinging lever 83 is pressed against the guide surface 41*a* of the movable guide 41. As shown in FIG. 7, when the movable-side paper feed mechanism section 35 moves, the swinging lever 83 takes a posture having rotated to the swinging lower limit position by the spring force. The microswitch 81 is turned on or off in response to the position of the swinging lever 83, thus detecting whether or not the movable-side paper feed mechanism section 35 is at the operating position, i.e., whether or not the cover 5 is at the closed position.

On the other hand, a slit 41*b* is formed in the width direction center portion of the movable guide 41. The swinging lever 84 of the microswitch 82 is always imparted a force by a force imparting member (not shown) such as a coil spring in a direction of being inserted into this slit 41*b*. The state in which the swinging lever 84 is inserted into the slit 41*b* represents the lowest limit of swinging of the swinging lever 84.

Therefore, when the movable-side paper feed mechanism section 35 is at the operating position, but the recording sheet 10*a* is not drawn out along the guide surface 41*a* of the movable guide 41, the swinging lever 84 falls in the slit 41*b*, thus detecting the paper absent state.

As is clear from FIG. 14A, these swinging levers 83 and 84 serve also as paper retainer for pressing the recording sheet to prevent the sheets from floating from the guide surface 41*a* of the movable guide 41.

Roll Paper Housing

Figure 15:
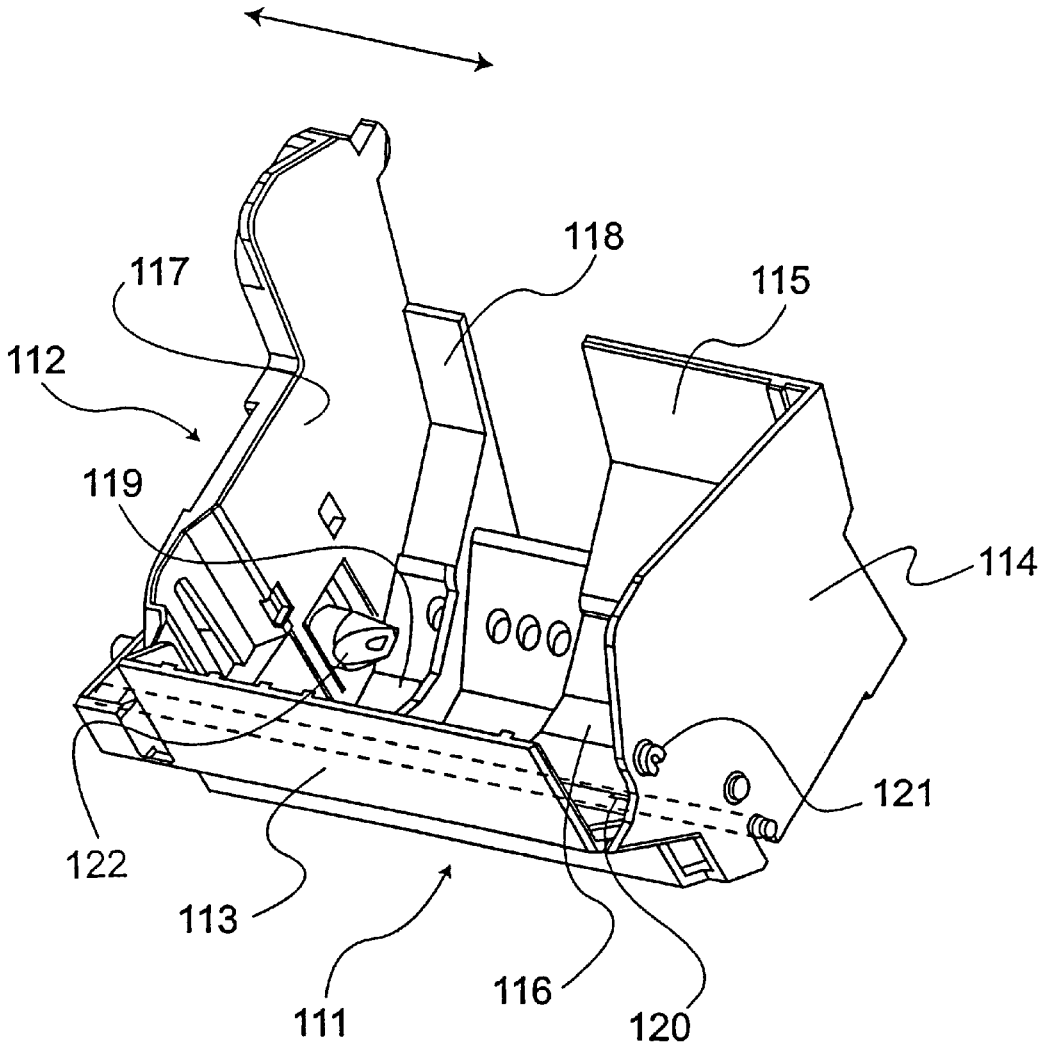
FIG. 15 is a partial perspective view showing the configuration of the roll paper housing.

The structure of the roll paper housing 11 will now be described. As shown in FIGS. 13 and 15, the roll paper housing 11 has a shape permitting drop-charging of the recording paper roll 10 from above, and comprises a roll paper holder 111 and a roll paper guide 112. The roll paper holder 111 is formed of a front wall portion 113, a right side wall portion 114, a rear wall portion 115, and a bottom wall portion 116. The roll paper guide 112 comprises a left wall portion 117, a rear wall portion 118 and a bottom wall portion 119.

A supporting shaft 120 rotatably passes horizontally through the bottom side portion of the roll paper holder 111 in the printer width direction. The supporting shaft 120 is supported by a bottom plate portion 1B of the main body frame 1A. An engagement projection 121 projecting in the transverse direction is formed at a front side position in the right wall portion 114 of the roll paper holder 111. When the rear-side swinging arm 54 forming the right parallel linking mechanism 50R falls down forward, the front end surface 54*a* of the swinging arm 54 hits the engagement projection 121.

Therefore, in the state in which the swinging arm 54 is tilted forward, i.e., the cover 5 is fully opened, the roll paper holder 111 as well rotates forward around the supporting shaft 120 to fall down, thus forming a state in which the upper opening thereof is directed diagonally forward. It is thus possible to drop the recording sheets from diagonally above into the roll paper holder 111. The charging operation of the recording paper roll is therefore simplified as compared with the case where the recording paper roll 10 is dropped from directly above.

On the other hand, the supporting shaft 120 extends while passing through also the bottom portion of the roll paper guide 112. The roll paper guide 112 is thus movable in the printer width direction along the supporting shaft 120. More specifically, it is movable in the arrow direction in FIG. 15, and this makes variable the gap between the left side wall portion 117 of the roll paper holder and the right side wall portion 114 of the roll paper holder. In this embodiment, as described above, the width of the roll paper housing can be changed in response to the width of the recording paper roll 10.

A detection lever 122 for detecting the remaining recording paper roll 10 is attached to the roll paper guide 112.

In the roll paper housing 11 of this embodiment, the roll paper holder 111 constituted by the front wall portion 113, the right wide wall portion 114, the rear wall portion 115 and the bottom wall portion 116, serves as a holder moving section which rotates forward as the cover 5 is opened. The holder moving section may include at least the front wall portion 113.

Opening/closing Operation of Cover 5

Opening and closing operations of the cover 5 in the roll paper printer of this embodiment having the configuration as described above will now be comprehensively described.

First, when the cover 5 is at the closed position 5A, as shown in FIGS. 9A, 9B and 9C, the hooks 73L and 73R of the operating lever 7 engage with the hook engaging grooves 75L and 75R formed in the main body case 1A by the action of the spring force of the coil springs 74L and 74R. In other words, the cover 5 is locked.

When opening the cover 5, the operating lever 7 is pushed up with fingers or the like against the spring force of the coil springs 74L and 74R. As a result, the operating lever 7 rotates around the supporting shaft 52, and the hooks 73L and 73R go down to come off the engaging grooves 75L and 75R, thereby locking is released (see FIG. 10). In this embodiment, as described above, the mechanism for unlocking is simplified, and this is advantageous for downsizing the roll paper printer.

Upon unlocking, the movable guide 41 also moves down, together with the hooks 73L and 73R, not in contact with the paper feed roller 25 of the fixed-side paper feed mechanism section 34.

After unlocking, the platen member 39 displaces forward while keeping the horizontal posture under the action of the four-node parallel linking mechanisms 50L and 50R by pulling the leading end portion of the operating lever 7.

Since the cover 5 is always pressed by the springs 74L and 74R against the swinging arms 53R and 53L, the cover 5 falls down forward around the supporting shaft 31 of the lower end 5*a* thereof in linkage with the swinging arms 53L and 53R.

By pulling the operating lever 7 toward the printer front, as described above, the cover 5 can be opened. When the cover 5 falls down forward, the front-side end surface 54*a* of the swinging arm 54R of the right parallel linking mechanism 50R come into contact from the rear side with the engagement projection 121 of the roll paper holder 111 of the roll paper housing 11. Subsequently, the roll paper holder 111 also falls down forward around the supporting shaft 120.

When the cover 5 is further opened beyond the semi-opened state shown in FIG. 11, the engagement projections 72*f*(L) and 72*f*(R) formed on the operating lever 7 come into contact with the contact surfaces 78L and 78R formed on the front left and right swinging arms 53L and 53R. When the cover 5 is further opened after formation of this state, the operating lever 7 is pushed out forward while being pushed up by the contact surfaces 78L and 78R. As a result, the operating lever 7 slowly rotates around the supporting shaft 52 so that the front end side thereof is directed upward.

In a state in which the cover 5 is fully opened as shown in FIGS. 2, 12 and 13, the roll paper housing 11 becomes fully opened, and the table body 71 of the operating lever 7 inclines upward. The roll paper holder 11 fall down forward. Therefore, it is possible to easily accomplish charging or replacement of the recording paper roll 10 from diagonally above.

In the full opened state of the cover 5, the end portions of the front side swinging arms 53L and 53R and the upper end portion of the cover 5 pressed against them are directed forward. Because they have different centers of rotation, when these both members are connected with linking members, falling down forward causes the gaps of these upper end portions to become gradually larger. In this embodiment, however, the cover 5 is not connected to the swinging arms 53L and 53R, but is pressed by the spring force of the coil springs 74L and 74R. Therefore, even when these members relatively move along with the rotation, gaps of the upper end portion of these members never become larger. This permits avoidance of troubles such as fingers caught by a gap or fingers injured upon closing the cover 5.

In this embodiment, the rollers 37 and 38, and the fixed edge 26*b* of the auto-cutter are attached to the platen member 39, and the movable-side paper feed mechanism section 35 comprising these components is separated from the fixed-side paper feed mechanism section 34 attached to the main body case 1A side. As a result, by arranging the recording sheet drawn out from the recording paper roll 10 on the movable-side paper feed mechanism section 35 and closing the cover 5 in this state, the recording sheet is automatically arranged in a printable state. It is thus possible to very easily accomplish charging operation of the recording paper roll.

Since the roll paper holder 111 also falls down forward, furthermore, it is possible easily conduct the charging operation of the recording paper roll 10 into the roll paper housing 11 as compared with the conventional case where the recording paper roll 10 is dropped into the roll paper holder 111 from above beyond the front wall portion 113 of the roll paper housing.

In this embodiment, as described above, the substantial opening area of the roll paper housing can be enlarged upon charging or replacing the recording paper roll. It is therefore possible to easily perform charging operation of the recording paper roll with a high operability. In other words, the substantial opening of the roll paper housing 11 can be enlarged in the open state of the cover 5 without the need to enlarge the opening of the roll paper housing. It is therefore possible to reduce the opening of the roll paper housing without the risk of impairing operability of the charging operation of the recording paper roll. This is very advantageous for achieving a smaller-sized and compact printer.

In this embodiment, furthermore, in the open state of the cover 5, the cutter fixed edge cover plate portion 72*b* of the operating lever 7 moves upward. As a result, the cutter fixed edge 26*b* is covered with the cutter fixed edge cover plate portion 72*b*. As a result, a finger, entering from the front side into the roll paper housing 11 never come into touch with the cutter fixed edge 26*b*. It is therefore possible to safely conduct the roll paper replacing operation.

In the operation of closing the cover 5 after charging the recording paper roll 10, a sufficient space is provided under the leading end portion, because the operating lever 7 is directed diagonally upward. It is therefore possible to carry out lifting operation of the paper discharge table 9, i.e., the closing operation of the cover 5 with a high operability.

When operation reaches the stage immediately before fully closing the cover 5 (the state shown in FIG. 10) by operating the operating lever 7, the operation assistants 77L and 77R formed on the front side swinging arms 53L and 53R come into contact with the corner portion 73*e* of the operating lever 7 and push them down. As a result, the hooks 73L and 73R of the operating lever 7 move backward while being pushed down. The operating force necessary for the hooks 73L and 73R to get over the lower surfaces of the engagement grooves 75L and 75R on the main body case 1A side is small.

When the cover 5 is moved to the closed position shown in FIGS. 9A, 9B and 9C, the operation assistants 77L and 77R come off the corner portion 73*e* of the operating lever 7. The side of the operating lever 7 of the hooks 73L and 73R move upward under the spring force, thus forming a locked state. As a result, the cover 5 is locked at the closed position.

According to the printer of the present invention, as described above, when the cover of the roll paper housing is opened, the movable-side paper feed mechanism section supported by the parallel linking mechanism moves along with this from the position above the roll paper housing toward the front of the printer. It is therefore possible to provide a wide space for charging the recording paper roll into the roll paper housing in the opened state of the cover.

When closing the cover 5, the movable-side paper feed mechanism section moves closer to the fixed-side paper feed mechanism section while keeping the posture thereof. It is thus possible to automatically form the printable state with the recording sheet held between them. Since the movable-side paper feed mechanism section is supported by the parallel linking mechanism, it is possible always position the movable-side paper feed mechanism section at an appropriate position relative to the printing head on the fixed-side with a high accuracy.

What is claimed is:

1. A printer comprising:

a roll paper housing;

a cover attached to a front surface of the printer for opening and closing said roll paper housing;

a printing head for printing on a tape-shaped recording sheet of paper delivered from a recording paper roll charged in said roll paper housing;

a paper feed mechanism for transferring said tape-shaped recording sheet through a printing position of said printing head, which has a fixed-side paper feed mechanism section and a movable-side paper feed mechanism section movable between an operating position engaging with said fixed-side paper feed mechanism and a shunting position distant from said fixed-side paper feed mechanism section; wherein said recording sheet is held between said fixed-side paper feed mechanism section and said movable-side paper feed mechanism section at said operating position; and a parallel linking mechanism which causes said movable-side paper feed mechanism section to move to said operating position in linkage with a closing operation of said cover, and causes said movable-side paper feed mechanism section to move from said operating position to said shunting position while keeping a posture at said operating position, in linkage with an opening operation of said cover, wherein said parallel linking mechanism has a pair of swinging arms, each of which has a lower end rotatably supported by a side of said roll paper housing and an upper end hinge-connected by said movable-side paper feed mechanism section.

2. A printer comprising:

a roll paper housing;

a cover attached to a front surface of the printer for opening and closing said roll paper housing;

a printing head for printing on a tape-shaped recording sheet of paper delivered from a recording paper roll charged in said roll paper housing;

a paper feed mechanism for transferring said tape-shaped recording sheet through a printing position of said printing head, which has a fixed-side paper feed mechanism section and a movable-side paper feed mechanism section movable between an operating position engaging with said fixed-side paper feed mechanism and a shunting position distant from said fixed-side paper feed mechanism section; wherein said recording sheet is held between said fixed-side paper feed mechanism section and said movable-side paper feed mechanism section at said operating position; and a parallel linking mechanism which causes said movable-side paper feed mechanism section to move to said operating position in linkage with a closing operation of said cover, and causes said movable-side paper feed mechanism section to move from said operating position to said shunting position while keeping a posture at said operating position, in linkage with an opening operation of said cover, wherein said fixed-side paper feed mechanism section comprises a first roller and a second roller arranged in the upstream and in the downstream, respectively, of said printing head in a recording paper transferring direction;

said movable-side paper feed mechanism section comprises a third roller in contact with said first roller and a fourth roller in contact with said second roller at said operating position; and said recording sheet is transferred between said first and third rollers, and between said second and fourth rollers.

3. A printer according to claim 2, wherein:

said fixed-side paper feed mechanism section further comprises a motor driving one of said first and second rollers, and a driven gear for transferring the driving force of said motor to said movable-side paper feed mechanism section; and said movable-side paper feed mechanism section further comprises a follower gear engaging with said driven gear at said operating position, and one of said third and fourth rollers is driven by the driving force of said motor transferred to said follower gear.

4. A printer according to claim 3, wherein:

said first and fourth rollers are driven by said motor; and said movable-side paper feed mechanism section has a spring which presses said third roller against said first roller at said operating position.

5. A printer according to claim 4, wherein:

said second roller has a slight contact portion for pressing against a recording sheet transferred between said second roller and said fourth roller, so as to rotate along with rotation of said fourth roller.

6. A printer according to claim 5, wherein:

said movable-side paper feed mechanism section comprises a roller supporting member rotatably supporting said third and fourth rollers, and a platen plate attached to said roller supporting member and arranged between said third and fourth rollers; and said pair of swinging arms have ends hinge-connected to said roller supporting member.

7. A printer according to claim 1, further comprising:

an operating lever vertically rotatably attached to said movable-side paper feed mechanism section, and a locking mechanism for locking said movable-side paper feed mechanism section at said operating position;

wherein, when said operating lever is lifted, a locking of said movable-side paper feed mechanism section by said locking mechanism is released.

8. A printer according to claim 7, wherein:

said operating lever has a guide table projecting from said movable-side paper feed mechanism section in front of a printer body; and when said movable-side paper feed mechanism section is at said opening position, the recording sheet discharged between said movable-side paper feed mechanism section and said fixed-side paper feed mechanism section to outside is guided by said guide table.

9. A printer according to claim 7, wherein;

said locking mechanism comprises a vertically rotatable hook integrally with said operating lever, a hook receiver with which said hook is engageable from below, and a spring imparting a force to said hook in a direction of engaging with said hook receiver.

10. A printer according to claim 7, further comprising:

operating lever rotating means for vertically rotating said operating lever relative to said movable-side paper feed mechanism section in linkage with opening and closing of said cover.

11. A printer according to claim 10, wherein:

said operating lever rotating means comprises an engagement section formed on said operating lever at a position in front of a printer body from a rotation center of said operating lever, and an engaged section formed on said parallel linking mechanism; and said engagement section engages with said engaged section in linkage with an opening operation of said cover, and pushes up said operating lever around said rotation center so that a front side portion thereof moves upward.

12. A printer according to claim 10, wherein:

said operating lever rotating means comprises an engagement section formed on said operating lever at a position in front of a printer body from a rotation center of said operating lever, and an engaged section formed on said parallel linking mechanism; and said engagement section engages with said engaged section in linkage with the closing operation of said cover, and causes said operating lever around the rotation center so that a rear side portion thereof moves downward, and when said operating position is reached by said movable-side paper feed mechanism section, engagement between said engagement section and said engaged section is released.

13. A printer according to claim 7, further comprising:

a recording sheet cutting cutter which has a movable edge provided in said fixed-side paper feed mechanism section, and a fixed edge provided in said movable-side paper feed mechanism section; and said operating lever has a protecting cover covering a front portion of said fixed edge when the movable-side paper feed mechanism section is at said shunting position.

14. A printer according to claim 7, further comprising:

a movable guide for guiding a recording sheet delivered from the recording sheet roll housed in said roll paper housing into said paper feed mechanism section;

wherein said movable guide is attached to said movable-side paper feed mechanism section, and moves in linkage with said operating lever.

15. A printer according to claim 14, wherein:

said movable guide rotates around a rotation center of said operating lover integrally therewith.

16. A printer according to claim 14, wherein:

said fixed-side paper feed mechanism section has a first roller and a second roller arranged in the upstream and in the downstream, respectively, of said printing head in the recording sheet transferring direction;

said movable-side paper feed mechanism section has a third roller in contact with said first roller and a fourth roller in contact with said second roller at said operating position; and said recording sheet is transferred between said first and third rollers and between said second and fourth rollers, and further comprising:

a spring which presses said movable guide so as to be positioned on said first roller side relative to the contact positions of said first and third rollers, when said movable-side paper feed mechanism section is at said operating position.

17. A printer according to any one of claims 14 to 16, further comprising:

a guide detector detecting a position of said movable guide, and a recording sheet detector which detects whether or not there is a recording sheet on said movable guide when said movable-side paper feed mechanism section is at said operating position.

18. A printer according to claim 1, wherein:

said roll paper housing has a roll holder supporting said recording sheet roll;

at least a part of the roll holder is a holder moving section forwardly rotatable around a lower end thereof; and said holder moving section rotates forwardly in linkage with the opening operation of said cover.

19. A printer according to claim 18, wherein:

said roll holder comprises a bottom wall portion, a front wall portion opposite to said cover, a rear wall portion, and right and left side portions; and said holder moving section includes at least said front wall portion.

20. A printer according to claim 1, wherein;

said cover has a lower end rotatably coupled to said roll paper housing; and further comprising:

a spring always pressing said cover against said parallel linking mechanism.

21. A printer comprising:

a roll paper housing;

a cover attached to a front surface of the printer for opening and closing said roll paper housing;

a printing bead for printing on a paper delivered from a paper roll charged in said roll paper housing;

a paper feed mechanism for transferring said paper through a printing position of said printing head, which has a fixed-side paper feed mechanism section and a movable-side paper feed mechanism section; and a parallel linking mechanism for movably supporting said movable-side paper feed mechanism section relative to said fixed-side paper feed mechanism section between an operating position in which said movable-side paper feed mechanism section engages with said fixed-side paper feed mechanism and a shunting position in which said movable-side paper feed mechanism section disengages from said fixed-side paper feed mechanism section, said parallel linking mechanism causing said movable-side paper feed mechanism section to move to said operating position in linkage with a closing operation of said cover, said paper being held between said fixed-side paper feed mechanism section and said movable-side paper feed mechanism section at said operating position, wherein said parallel linking mechanism has a pair of swinging arms, each of which has a lower end rotatably supported by a side of said roll paper housing and an upper end hinge-connected by said movable-side paper feed mechanism section.

22. A printer according to claim 21, further comprising:

an operating lever rotatably attached to said movable-side paper feed mechanism section, and a locking mechanism for locking said movable-side paper feed mechanism section at said operating position, wherein a locking of said movable-side paper feed mechanism section by said locking mechanism is released when said operating lever is turned.

23. A printer according to claim 22, wherein said operating lever has a guide table projecting from said front surface of the printer; and said guide table guides the paper discharged from said paper feed mechanism when said movable-side paper feed mechanism section is at said operating position.

24. A printer according to claim 22, further comprising:

a movable guide for guiding the paper delivered from the paper roll housed in said roll paper housing into said paper feed mechanism section, wherein said movable guide is movably attached to said movable-side paper feed mechanism section so as to move in linkage with said operating lever.

25. A printer according to claim 24, wherein said movable guide arranged to rotate around a rotation center of said operating lever.

26. A printer according to claim 24, further comprising:

a guide detector detecting a position of said movable guide, and a paper detector which detects whether or not there is a paper on said movable guide when said movable-side paper feed mechanism section is at said operating position.

27. A printer according to claim 21, wherein said cover has a lower end rotatably supported on a side of said roll paper housing, further comprising:

a spring always pressing said cover against said parallel linking mechanism.

28. A printer comprising:

a roll paper housing;

a cover attached to a front surface of the printer for opening and closing said roll paper housing;

a printing head for printing on a paper delivered from a paper roll charged in said roll paper housing;

a paper feed mechanism for transferring said paper through a printing position of said printing head, which has a fixed-side paper feed mechanism section and a movable-side paper feed mechanism section; and a parallel linking mechanism for movably supporting said movable-side paper feed mechanism section relative to said fixed-side paper feed mechanism section between an operating position in which said movable-side paper feed mechanism section engages with said fixed-side paper feed mechanism and a shunting position in which said movable-side paper feed mechanism section disengages from said fixed-side paper feed mechanism section, said parallel linking mechanism causing said movable-side paper feed mechanism section to move to said operating position in linkage with a closing operation of said cover, said paper being held between said fixed-side paper feed mechanism section and said movable-side paper feed mechanism section at said operating position;

wherein said fixed-side paper feed mechanism section comprises a first roller and a second roller arranged in the upstream and in the downstream, respectively, of said printing head in a transferring direction of the paper; said movable-side paper feed mechanism section comprises a third roller in contact with said first roller and a forth roller in contact with said second roller at said operating position; and said paper is transferred between said first and third rollers, and between said second and fourth rollers.

29. A printer according to claim 28, further comprising:

a movable guide for guiding the paper delivered from the paper roll housed in said roll paper housing into said paper feed mechanism section, said movable guide being movably attached to said movable-side paper feed mechanism section; and a spring which presses said movable guide so as to be positioned on said first roller side relative to the contact positions of said first and third rollers, when said movable-side paper feed mechanism section is at said operating position.

30. A printer according to claim 28, wherein said fixed-side paper feed mechanism section further comprises a motor driving one of said first and second rollers, and a driven gear for transferring the driving force of said motor to said movable-side paper feed mechanism section, and wherein said movable-side paper feed mechanism section further comprises a follower gear engaging with said driven gear at said operating position, and one of said third and fourth rollers is driven by the driving force of said motor transferred to said follower gear.

31. A printer according to claim 30, wherein said first and fourth rollers are driven by said motor, and wherein said movable-side paper feed mechanism section has a spring which presses said third roller against said first roller at said operating position.

32. A printer according to claim 31, wherein said second roller has a slight contact portion for pressing against a paper transferred between said second roller and said fourth roller, so as to rotate along with rotation of said fourth roller.

33. A printer according to claim 32, wherein said movable-side paper feed mechanism section comprises a roller supporting member rotatably supporting said third and fourth rollers, and a platen plate attached to said roller supporting member and arranged between said third and fourth rollers, and wherein said parallel linking mechanism has a pair of swinging arms, each of which has a lower end rotatably supported by a side of said roll paper housing and an upper end hinge-connected to said roller supporting member.

34. A printer comprising:

a roll paper housing;

a cover attached to a front surface of the printer for opening and closing said roll paper housing;

a printing head for printing on a paper delivered from a paper roll charged in said roll paper housing;

a paper feed mechanism for transferring said paper through a printing position of said printing head, which has a fixed-side paper feed mechanism section and a movable-side paper feed mechanism section;

a parallel linking mechanism for movably supporting said movable-side paper feed mechanism section relative to said fixed-side paper feed mechanism section between an operating position in which said movable-side paper feed mechanism section engages with said fixed-side paper feed mechanism and a shunting position in which said movable-side paper feed mechanism section disengages from said fixed-side paper feed mechanism section, said parallel linking mechanism causing said movable-side paper feed mechanism section to move to said operating position in linkage with a closing operation of said cover, said paper being held between said fixed-side paper feed mechanism section and said movable-side paper feed mechanism section at said operating position;

an operating lever rotatably attached to said movable-side paper feed mechanism section; and a locking mechanism for locking said movable-side paper feed mechanism section at said operating position, wherein a locking of said movable-side paper feed mechanism section by said locking mechanism is released when said operating lever is lifted, and wherein said locking mechanism comprises a hook integrally with said operating lever, a hook receiver with which said hook is engageable from below, and a spring imparting a force to said hook in a direction of engaging with said hook receiver.

35. A printer comprising:

a roll paper housing;

a cover attached to a front surface of the printer for opening and closing said roll paper housing;

a printing head for printing on a paper delivered from a paper roll charged in said roll paper housing;

a paper feed mechanism for transferring said paper through a printing position of said printing head, which has a fixed-side paper feed mechanism section and a movable-side paper feed mechanism section;

a parallel linking mechanism for movably supporting said movable-side paper feed mechanism section relative to said fixed-side paper feed mechanism section between an operating position in which said movable-side paper feed mechanism section engages with said fixed-side paper feed mechanism and a shunting position in which said movable-side paper feed mechanism section disengages from said fixed-side paper feed mechanism section, said parallel linking mechanism causing said movable-side paper feed mechanism section to move to said operating position in linkage with a closing operation of said cover, said paper being held between said fixed-side paper feed mechanism section and said movable-side paper feed mechanism section at said operating position;

an operating lever rotatably attached to said movable-side paper feed mechanism section;

a locking mechanism for locking said movable-side paper feed mechanism section at said operating position such that a locking of said movable-side paper feed mechanism section by said locking mechanism is released when said operating lever is lifted; and operating lever rotating means for rotating said operating lever relative to said movable-side paper feed mechanism section in linkage with opening and closing of said cover.

36. A printer according to claim 35, wherein said operating lever rotating means comprises an engagement section formed on said operating lever at a position in front of a printer body from a rotation center of said operating lever, and an engaged section formed on said parallel linking mechanism, and wherein said engagement section engages with said engaged section in linking with an opening operation of said cover, and pushes up said operating lever around said rotation center so that a front side portion thereof moves upward.

37. A printer according to claim 35, wherein said operating lever rotating means comprises an engagement section formed on said operating lever at a position in front of a printer body from a rotation center of said operating lever, and an engaged section formed on said parallel linking mechanism, wherein said engagement section engages with said engaged section in linkage with the closing operation of said cover, and causes said operating lever around the rotation center so that a rear side portion thereof moves downward, and wherein said engagement section disengages from said engaged section said engaged section when said movable-side paper feed mechanism section has reached said operating position.

38. A printer comprising:

a roll paper housing;

a cover attached to a front surface of the printer for opening and closing said roll paper housing;

a printing head for printing on a paper delivered from a paper roll charged in said roll paper housing;

a paper feed mechanism for transferring said paper through a printing position of said printing head, which has a fixed-side paper feed mechanism section and a movable-side paper feed mechanism section;

a parallel linking mechanism for movably supporting said movable-side paper feed mechanism section relative to said fixed-side paper feed mechanism section between an operating position in which said movable-side paper feed mechanism section engages with said fixed-side paper feed mechanism and a shunting position in which said movable-side paper feed mechanism section disengages from said fixed-side paper feed mechanism section, said parallel linking mechanism causing said movable-side paper feed mechanism section to move to said operating position in linkage with a closing operation of said cover, said paper being held between said fixed-side paper feed mechanism section and said movable-side paper feed mechanism section at said operating position;

an operating lever rotatably attached to said movable-side paper feed mechanism section;

a locking mechanism for locking said movable-side paper feed mechanism section at said operating position, wherein upon lifting said operating lever, a locking of said movable-side paper feed mechanism section by said locking mechanism is released;

a paper cutting cutter which has a movable edge provided in said fixed-side paper feed mechanism section; and a fixed edge provided in said movable-side paper feed mechanism section, wherein said operating lever has a protecting cover covering a front portion of said fixed edge when the movable-side paper feed mechanism section is at said shunting position.

39. A printer comprising:

a roll paper housing;

a cover attached to a front surface of the printer from opening and closing said roll paper housing;

a printing head for printing on a paper delivered from a paper roll charged in said roll paper housing;

a paper feed mechanism for transferring said paper through a printing position of said printing head, which has a fixed-side paper feed mechanism section and a movable-side paper feed mechanism section;

a parallel linking mechanism for movably supporting said movable-side paper feed mechanism section relative to said fixed-side paper feed mechanism section between an operating position in which said movable-side paper feed mechanism section engages with said fixed-side paper feed mechanism and a shunting position in which said movable-side paper feed mechanism section disengages from said fixed-side paper feed mechanism section, said parallel linking mechanism causing said movable-side paper feed mechanism section to move to said operating position in linkage with a closing operation of said cover, said paper being held between said fixed-side paper feed mechanism section and said movable-side paper feed mechanism section at said operating position, said parallel linking mechanism having a pair of swinging arms, each of which has a lower end rotatably supported by a side of said roll paper housing and an upper end hinge-connected by said movable-side paper feed mechanism section, wherein said roll paper housing has a roll holder supporting said paper roll, wherein said roll holder comprises a bottom wall portion, a front wall portion opposite to said cover, a rear wall portion, right and left side portions, wherein at least said front wall portion forms a holder moving section forwardly rotatable around a lower end thereof; and wherein said holder moving section rotates forwardly in linkage with the opening operation of said cover.

* * * * *